US012214988B2

(12) United States Patent
Kamiyama et al.

(10) Patent No.: US 12,214,988 B2
(45) Date of Patent: Feb. 4, 2025

(54) TRANSPORT DEVICE AND PRINTING APPARATUS

(71) Applicant: SEIKO EPSON CORPORATION, Tokyo (JP)

(72) Inventors: Nobuaki Kamiyama, Matsumoto (JP); Takahiro Yamashita, Matsumoto (JP); Junpei Yamashita, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 193 days.

(21) Appl. No.: 18/161,427

(22) Filed: Jan. 30, 2023

(65) Prior Publication Data

US 2023/0242359 A1 Aug. 3, 2023

(30) Foreign Application Priority Data

Jan. 31, 2022 (JP) ..... 2022-013327

(51) Int. Cl.
*B65H 5/02* (2006.01)

(52) U.S. Cl.
CPC ..... *B65H 5/025* (2013.01); *B65H 2404/5391* (2013.01); *B65H 2515/84* (2013.01); *B65H 2801/21* (2013.01)

(58) Field of Classification Search
CPC .. B65H 2301/5113; B65H 2301/51132; B65H 2301/44335; B65H 2404/5391
See application file for complete search history.

(56) References Cited

U.S. PATENT DOCUMENTS

| | | | | |
|---|---|---|---|---|
| 5,764,264 | A * | 6/1998 | Takanaka | B41J 3/4078 242/562 |
| 9,156,289 | B2 * | 10/2015 | Nakamura | B65H 23/198 |
| 10,377,129 | B2 * | 8/2019 | Ishikawa | B41J 2/04581 |
| 11,383,542 | B2 * | 7/2022 | Kitagishi | B65H 29/54 |
| 11,932,006 | B2 * | 3/2024 | Aoki | B41J 11/0015 |
| 12,098,054 | B2 * | 9/2024 | Yumoto | B41J 15/048 |
| 2019/0291475 | A1 * | 9/2019 | Ota | B41J 11/007 |
| 2022/0033207 | A1 * | 2/2022 | Fujioka | B41J 11/42 |
| 2022/0305616 | A1 * | 9/2022 | Pleuger | B24B 21/06 |
| 2023/0294948 | A1 * | 9/2023 | Minemura | B41J 15/048 226/171 |

FOREIGN PATENT DOCUMENTS

| | | | |
|---|---|---|---|
| JP | 2016-150434 | A | 8/2016 |
| JP | 2020033116 | A * | 3/2020 |

* cited by examiner

*Primary Examiner* — Howard J Sanders
(74) *Attorney, Agent, or Firm* — WORKMAN NYDEGGER

(57) ABSTRACT

A transport device includes a transport belt, an abutting unit, a moving mechanism, and a displacement detection unit. The transport belt has an adhesive layer capable of adhering to a medium, and is capable of transporting the medium adhering to the adhesive layer. The abutting unit is capable of abutting against a surface of the adhesive layer. It is assumed that a direction in which the abutting unit is away from the adhesive layer is a first direction and a direction opposite thereto is a second direction. The moving mechanism is capable of moving a position of the abutting unit with respect to the surface in the first direction and the second direction. The displacement detection unit detects a displacement amount of the transport belt in the first direction when the moving mechanism moves the abutting unit in the first direction while the abutting unit abuts against the surface.

7 Claims, 10 Drawing Sheets

SD

| FABRIC TYPE | THRESHOLD VALUE SH |
|---|---|
| FIRST FABRIC | SH1 |
| SECOND FABRIC | SH2 |
| THIRD FACBRIC | SH3 |
| ... | ... |
| n-TH FABRIC | SHn |

TRANSPORT DEVICE AND PRINTING APPARATUS

The present application is based on, and claims priority from JP Application Serial Number 2022-013327, filed Jan. 31, 2022, the disclosure of which is hereby incorporated by reference herein in its entirety.

BACKGROUND

1. Technical Field

The present disclosure relates to a transport device including a transport belt for transporting a medium and a printing apparatus.

2. Related Art

JP-A-2016-150434 discloses, as an example of a printing apparatus of this type, an ink-jet printing apparatus (printing apparatus) that performs printing on a sheet (an example of a medium). The printing apparatus includes a sheet transport device (an example of a transport device) that transports the sheet on a transport belt having an adhesive layer formed of adhesive rubber and a print unit (an example of a printing unit) that performs printing an image on the sheet being transported.

The sheet transport device described in JP-A-2016-150434 includes a detection means that detects an adhesive force of the adhesive layer and an adjustment means that adjusts the adhesive force of the adhesive layer, based on a detection result obtained by the detection means. The detection means includes a plate spring formed into a J-like shape and a pressing member that causes the plate spring to abut against the adhesive layer with a constant load. A deformation amount of the plate spring, which is generated when the plate spring is dragged in a transport direction with respect to the adhesive layer, is detected, and thus the adhesive force of the adhesive layer is calculated.

The plate spring is dragged in the transport direction by the adhesive force of the adhesive layer, is deformed in the same direction, and then is restored to the original shape due to an elastic restoring force of the plate spring itself. A cyclically repetitive operation of the plate spring is detected by a strain gauge, and a stress calculation circuit calculates a change in stress acting on the plate spring and the strain gauge, which is changed in accordance with the adhesive force of the adhesive layer. The adhesive fore calculation circuit calculates any one of a cycle and an amplitude of an output waveform of the stress, and calculates the adhesive force of the adhesive layer while referring to a table that is stored in a memory and relates to the adhesive force.

However, the adhesive force of the adhesive layer has angle dependency, that is, dependency on an angle formed between a surface of the adhesive layer and a peeling direction. the transport device described in JP-A-2016-150434 has a configuration in which the plate spring is dragged along the surface of the adhesive layer of the transport belt, and hence there may be a risk that the adhesive force with which the medium such as a sheet adheres to the adhesive layer is not accurately reflected. Further, in the configuration in which the plate spring is dragged along the surface of the adhesive layer of the transport belt, the adhesive layer receives a large sliding resistance from the plate spring. Thus, when detection continues in such a way, the adhesive layer is quickly degraded.

SUMMARY

In order to solve the above-mentioned problem, a transport device includes a transport belt having an adhesive layer to which a medium is adherable and being configured to transport the medium adhering to the adhesive layer, an abutting unit configured to abut against a surface of the adhesive layer, a moving mechanism configured to move a position of the abutting unit with respect to the surface in a first direction and a second direction, the first direction being a direction in which the abutting unit is away from the adhesive layer, the second direction being a direction opposite to the first direction and a direction in which the abutting unit approaches the adhesive layer, and a displacement detection unit configured to detect a displacement amount of the transport belt in the first direction, when the moving mechanism moves the abutting unit in the first direction while the abutting unit abuts against the surface.

In order to solve the above-mentioned problem, a printing apparatus includes a transport belt having an adhesive layer to which a medium is adherable and being configured to transport the medium adhering to the adhesive layer, a printing unit configured to perform printing on the medium transported by the transport belt, an abutting unit configured to abut against a surface of the adhesive layer, a moving mechanism configured to move a position of the abutting unit with respect to the surface in a first direction and a second direction, the first direction being a direction in which the abutting unit is away from the adhesive layer, the second direction being a direction opposite to the first direction and a direction in which the abutting unit approaches the adhesive layer, and a displacement detection unit configured to detect a displacement amount of the transport belt in the first direction, when the moving mechanism moves the abutting unit in the first direction while the abutting unit abuts against the surface.

DESCRIPTION OF EXEMPLARY EMBODIMENTS

First Exemplary Embodiment

Figure 1:
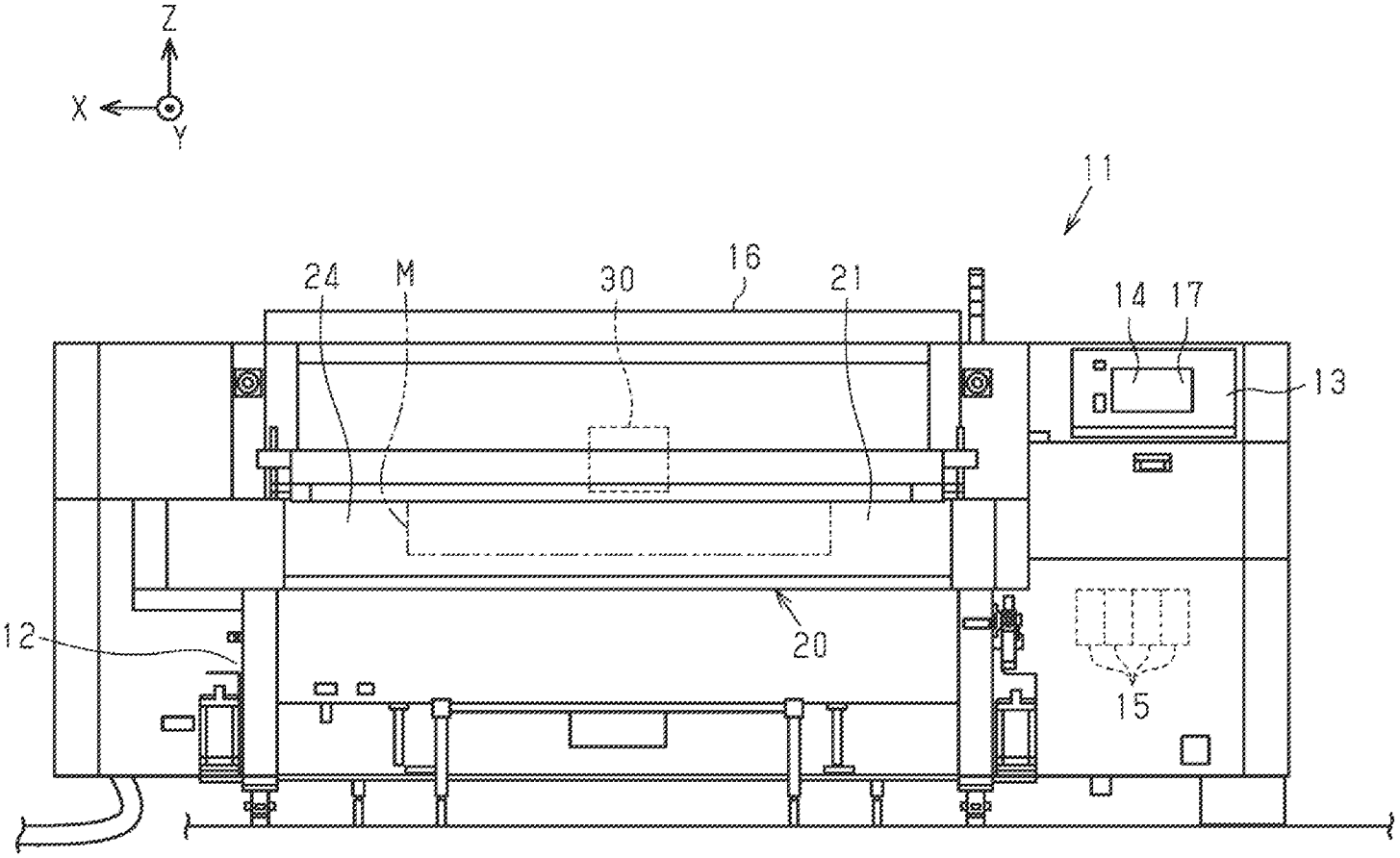
FIG. 1 is a front view illustrating a printing apparatus including a transport device according to a first exemplary embodiment.

With reference to the drawings, a printing apparatus 11 according to a first exemplary embodiment is described below. In the drawings, the direction of gravity is indicated by a Z axis while assuming that the printing apparatus 11 is placed on a horizontal plane, and directions along the horizontal plane are indicated by an X axis and a Y axis. The X axis, the Y axis, and the Z axis are orthogonal to one another. In the following description, a direction along the X axis, a direction along the Y axis, and a direction along the Z axis are also referred to as a width direction X, a transport direction Y, and a vertical direction Z, respectively. The X axis is a virtual axis parallel to the width direction X of a transport belt 21 described later, and the Y axis is a virtual axis parallel to the transport direction Y of a medium M on the transport belt 21. Note that a direction in which the transport belt 21 circles around is also referred to as the circling direction CD.

Configuration of Printing Apparatus 11

As illustrated in FIG. 1, the printing apparatus 11 includes a transport device 20 and a printing unit 30. The transport device 20 includes the transport belt 21 that transports the medium M. The transport belt 21 supports and transports the medium M such as fabric and sheet on an outer circumferential surface 24.

The printing apparatus 11 includes a housing 12 having a beam-column structure. The printing apparatus 11 includes an operation unit 13. The operation unit 13 is configured by an operation panel including the display unit 14, for example. The printing apparatus 11 includes a notification unit 17 that issues a notification of information. The display unit 14 may also function as the notification unit 17. In this case, the notification unit 17 issues a notification through display of information. The display unit 14 may be achieved by a touch-panel type display device or the like. The operation unit 13 is capable of providing an instruction to the printing apparatus 11 when a user performs an operation on a screen of the display unit 14. Note that the operation unit 13 may be achieved by an operation button or the like. In this case, the printing apparatus 11 may include the display unit 14 separately from the operation unit 13.

Further, the printing apparatus 11 includes ink supply sources 15 that supply ink used when the printing unit 30 performs printing on the medium M. Each of the ink supply sources 15 accommodates ink of one color among a plurality ink colors. The ink colors include cyan, magenta, yellow, black, and the like. For example, the printing unit 30 ejects the ink supplied from the ink supply source 15 onto the medium M, and thus performs printing of an image or the like on the medium M. Note that the ink supply source 15 may be an ink cartridge, or may be an ink tank.

Figure 2:
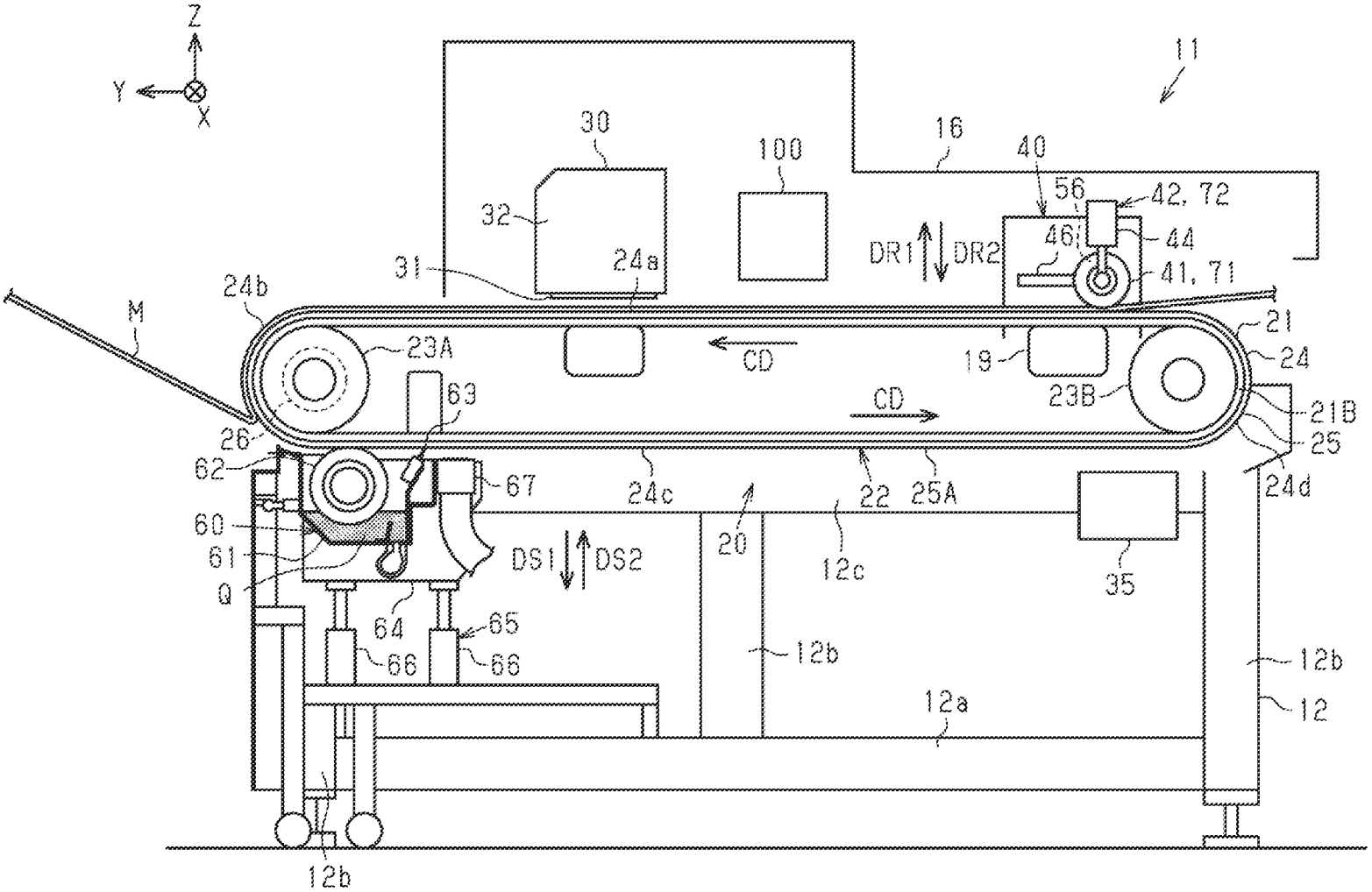
FIG. 2 is a schematic side cross-sectional view illustrating the printing apparatus.

As illustrated in FIG. 2, the printing apparatus 11 includes the transport device 20. The transport device 20 is supported by the housing 12. Further, the printing apparatus 11 includes the printing unit 30 described above and a control unit 100 that controls the transport device 20 and the printing unit 30. The printing unit 30 performs printing on the medium M transported by the transport belt 21. The printing unit 30, the control unit 100, and the like are covered with a cover 16.

The housing 12 has a beam-column structure including a bottom frame 12*a*, a column frame 12*b*, and an upper frame 12*c*. The cover 16 is an exterior member that covers the respective units of the printing apparatus 11.

The printing unit 30 includes an ejection unit 31 that ejects a liquid such as ink. The printing unit 30 ejects a liquid such as ink from the ejection unit 31 onto the medium M supported by the transport belt 21, and thus performs a printing operation for printing an image or the like on the medium M.

The transport device 20 includes a transport unit 22 including the rotatable transport belt 21. Further, the transport device 20 includes a cleansing unit 60 that performs cleansing for the transport belt 21, a drying unit 67 that dries the transport belt 21 after cleansing, and a first heating unit 35 that heats the transport belt 21.

As illustrated in FIG. 2, the transport unit 22 is provided to the upper part of the housing 12, and includes a driving roller 23A, a driven roller 23B, and the transport belt 21. Further, the transport unit 22 is capable of transporting the medium M in the +Y direction due to movement of the transport belt 21 by rotation of the driving roller 23A. Each of the driving roller 23A and the driven roller 23B includes a rotation shaft along the X direction. The printing apparatus 11 includes a feeding unit 18 that feeds the medium M to adhere to the transport belt 21. Note that the printing apparatus 11 is used in a combination with a winding device, which is omitted in illustration, for peeling and winding the medium M after printing from the transport belt 21.

The transport belt 21 is an endless belt having elasticity. The transport belt 21 is wound about the outer circumferences of the driving roller 23A and the driven roller 23B. The transport unit 22 rotatably drives the driving roller 23A, and thus rotates the endless transport belt 21 in a predetermined circling path.

The transport belt 21 has an adhesive layer 25 capable of adhering to the medium M. The transport belt 21 is configured to be capable of transporting the medium M adhering to the adhesive layer 25. Specifically, the transport belt 21 has an endless belt base material 21B and the adhesive layer 25 formed as a layer on an outer circumferential surface of the belt base material 21B. The medium M adheres to a surface 25A of the adhesive layer 25. The transport belt 21 is capable of transporting the medium M adhering to the adhesive layer 25 in the transport direction Y. The adhesive layer 25 has adhesive characteristics that enable temporary adhesion with another member and peeling from an adhering state. Here, the adhesive layer 25 of a heat-sensitive type and that of a pressure-sensitive type are present. The adhesive layer 25 of a heat-sensitive type has such characteristics that an adhesive force is increased as a temperature rises. The adhesive layer 25 of a pressure-sensitive type has such characteristics that an adhesive force is increased as a pressure is increases. The adhesive layer 25 in this example is a heat-sensitive type. Thus, the transport device 20 includes the first heating unit 35 that heats the adhesive layer 25. Note that, when the adhesive layer 25 is a pressure-sensitive type, the first heating unit 35 may be omitted. Here, the adhesive layer 25 of a pressure-sensitive type also has such characteristics that an adhesive force is increased as a temperature rises. When it is assumed that a degree of a change $\Delta F$ in an adhesive force with respect to a temperature change $\Delta T$ is $\Delta F/\Delta T$, $\Delta F/\Delta T$ of the adhesive layer 25 of a heat-sensitive type is greater than ΔF/ΔT of the adhesive layer 25 of a pressure-sensitive type.

The outer circumferential surface 24 of the transport belt 21 is divided into a plurality of portions in accordance with positions and shapes. In other words, the outer circumferential surface 24 is divided into an upper surface portion 24*a*, a downstream curved surface portion 24*b*, a lower surface portion 24*c*, and an upstream curved surface portion 24*d*. The upper surface portion 24*a* is a portion that is positioned in the +Z direction with respect to the center of the driving roller 23A and has a flat surface along the X-Y plane. The upper surface portion 24*a* is a portion of the transport belt 21 that faces the printing unit 30 in the circling direction CD. The upper surface portion 24*a* is a portion of the transport belt 21 that supports the medium M. The curved surface portion 24*b* is a portion having a curved surface of the transport belt 21 that is wound bout the driving roller 23A. The medium M adhering to the adhesive layer 25 peels off in the middle of the curved surface portion 24*b*. In addition, the lower surface portion 24*c* is a portion that is positioned in the −Z direction with respect to the center of the driving roller 23A and has a flat surface along the X-Y plane. Further, the curved surface portion 24*d* is a portion of the transport belt 21 that is wound about the driven roller 23B. Therefore, at least the surface of the upper surface portion 24*a* and the surface of the curved surface portion 24*b* function as a support surface of the transport belt 21 that supports the medium M. Note that, in addition to the surface of the upper surface portion 24*a* and the surface of the curved surface portion 24*b*, the surface of the curved surface portion 24*d* may function as a support surface of the transport belt 21 that supports the medium M.

The transport device 20 includes a transport motor 26 being a driving source of the driving roller 23A. The control unit 100 drives the transport motor 26, and thus controls driving and stoppage of the transport belt 21 and a transport speed during the driving.

The transport device 20 includes an abutting unit 71 capable of abutting against the surface 25A of the transport belt 21. Here, it is assumed that a direction in which the abutting unit 71 is away from the adhesive layer 25 is a first direction DR1 and a direction being a direction opposite to the first direction DR1 and a direction in which the abutting unit 71 approaches the adhesive layer 25 is a second direction DR2. The first direction DR1 and the second direction DR2 are directions intersecting with the surface of the upper surface portion 24*a*. A moving mechanism 42 is configured to be capable of moving the position of the abutting portion with respect to the surface 25A in the first direction DR1 and the second direction DR2.

As illustrated in FIG. 2, the transport device 20 includes the abutting unit 71 capable of abutting against the surface 25A of the adhesive layer 25. In this example, as the abutting unit 71, a pressurizing roller 41 is used. The pressurizing roller 41 presses the medium M against the adhesive layer 25 so that the medium M adheres to the adhesive layer 25.

The transport device 20 includes a pressurizing mechanism 40 that presses the medium M against the adhesive layer 25. The pressurizing mechanism 40 includes the pressurizing roller 41 that presses the medium M against the adhesive layer 25.

The pressurizing roller 41 presses the medium M against the surface 25A so that the medium M transported from upstream of the transport unit 22 adheres to the surface 25A of the transport belt 21. In other words, the pressurizing roller 41 pressurizes the part of the medium M, which is supported on the surface 25A. The pressurizing roller 41 is movable in the first direction DR1 and the second direction DR2 that intersect with the surface 25A, which enables pressing. The pressurizing mechanism 40 includes the moving mechanism 42 that moves the pressurizing roller 41 in the first direction DR1 and the second direction DR2. The moving mechanism 42 includes a moving unit 44 being a driving source for moving the pressurizing roller 41. The moving unit 44 may be a cylinder, for example.

Driving of the moving unit 44 causes the pressurizing roller 41 to be movable in the first direction DR1 and the second direction DR2 between a retraction position (omitted in illustration) away from the surface 25A and a butting position for pressing against the medium M. The moving unit 44 moves (lowers) the pressurizing roller 41 from the retraction position in the second direction DR2, and thus the pressurizing roller 41 abuts against the medium M to press the medium M against the surface 25A of the transport belt 21.

Further, the pressurizing roller 41 is provided to be also movable in the transport direction Y. The pressurizing mechanism 40 includes a rail unit 46 that guides the pressurizing roller 41 in a movable manner in the +Y direction and the −Y direction of the transport direction Y. The moving unit 44 moves, in the first direction DR1 and the second direction DR2, the rail unit 46 that supports the pressurizing roller 41 in a guiding manner in the transport direction Y, and thus moves the pressurizing roller 41 in the first direction DR1 and the second direction DR2. The pressurizing mechanism 40 reciprocates in the +Y direction and the −Y direction within a predetermined range in the Y-axis direction while the pressurizing roller 41 presses the medium M against the surface 25A of the adhesive layer 25. With this, the medium M adheres to the surface 25A of the adhesive layer 25. Note that the transport device 20 includes a second heating unit 56 that heats the pressurizing roller 41.

As illustrated in FIG. 2, the printing unit 30 is provided above the transport device 20. The printing unit 30 is configured to be capable of performing printing on the medium M transported in the +Y direction. The printing unit 30 may be a serial printing type or a line printing type. When the printing unit 30 is a serial printing type, the printing unit 30 includes the ejection unit 31 and a carriage 32 that supports the ejection unit 31. The carriage 32 is provided in a reciprocable manner along the X direction. The ejection unit 31 is arranged in the +Z direction with respect to the medium M, and performs printing on the medium M by ejecting a liquid such as ink onto a printing surface of the medium M. The ejection unit 31 is controlled by the control unit 100. The medium M after printing peels off from the curved surface portion 24*b* of the transport belt 21 due to a force generated when the winding device, which is omitted in illustration, winds the medium M into a roll-like shape.

When the ejection unit 31 performs printing on the medium M, a liquid such as ink may adhere to the surface 25A of the transport belt 21 in some cases. For example, when the medium M is fabric, a liquid such as ink passing through the medium may adhere to the surface 25A in some cases. Further, when the medium M peels off from the surface 25A, waste thread of the fabric may remain on the surface 25A in some cases. A liquid such as ink adhering to the surface 25A may generate a stain on the medium M, and waste thread remaining on the surface 25A causes reduction of an adhesive force of the surface 25A to the medium M. The cleansing unit 60 is provided so as to remove a liquid adhering to the surface 25A or waste thread generated by a medium base material.

As illustrated in FIG. 2, the cleansing unit 60 performs cleansing for the transport belt 21 at the position corresponding to the lower surface portion 24*c*. Specifically, the cleansing unit 60 causes a cleansing solution Q to adhere to the surface 25A of the adhesive layer 25, and thus performs cleansing for the adhesive layer 25. The cleansing unit 60 includes a reservoir tank 61, a brush 62, and a squeegee 63 (blade). The reservoir tank 61 stores the cleansing solution Q. The brush 62 performs a cleaning operation by contacting with the surface 25A and brushing the surface 25A through use of the cleansing solution Q. The squeegee 63 abuts against the surface 25A, and removes the cleansing solution Q adhering to the surface 25A.

The transport device 20 includes a lifting and lowering mechanism 65 that lifts up and lowers the cleansing unit 60. The cleansing unit 60 is configured to be capable of being lifted up and lowered in the Z-axis direction with respect to the transport belt 21 by the lifting and lowering mechanism 65. The lifting and lowering mechanism 65 includes, as a driving source, one or a plurality of cylinders 66 (a plurality of cylinders in the example of FIG. 3), for example. A piston rod of the cylinder 66 is fixed to a frame 64 of the cleansing unit 60. The lifting and lowering mechanism 65 arranges the cleansing unit 60 at the retraction position at which the brush 62 and the squeegee 63 are away downward from the surface 25A during non-use, and arranges the cleansing unit 60 at a cleaning position at which the brush 62 and the squeegee 63 are brought into contact with the surface 25A during use.

It is assumed that the squeegee 63 is away from the adhesive layer 25 is a first direction DS1 and a direction being a direction opposite to the first direction DS1 and a direction in which the squeegee 63 approaches the adhesive layer 25 is a second direction DS2. The lifting and lowering mechanism 65 is configured to be capable of moving the position of the squeegee 63 with respect to the surface 25A in the first direction DS1 and the second direction DS2. Note that the brush 62 and the squeegee 63 are provided in the width direction X of the transport belt 21.

The drying unit 67 dries the transport belt 21 after cleansing. For example, the drying unit 67 blows hot air, and thus dries the surface 25A. For example, the drying unit 67 is only required to blow air onto the surface 25A. The first heating unit 35 heats the adhesive layer 25. Specifically, the heating unit 35 heats the adhesive layer 25 at a predetermined position within a range from upstream in the circling direction CD with respect to an adhering start position at which the medium M starts adhering to the adhesive layer 25 to downstream in the circling direction CD with respect to a cleansing position at which the cleansing unit 60 performs cleansing. The drying unit 67 and the first heating unit 35 are controlled by the control unit 100. Note that, even when the surface 25A of the transport belt 21 is subjected to cleansing by the cleansing unit 60, the adhesive layer 25 of the transport belt 21 is gradually degraded as being used, and an adhesive force thereof is reduced.

Figure 7:
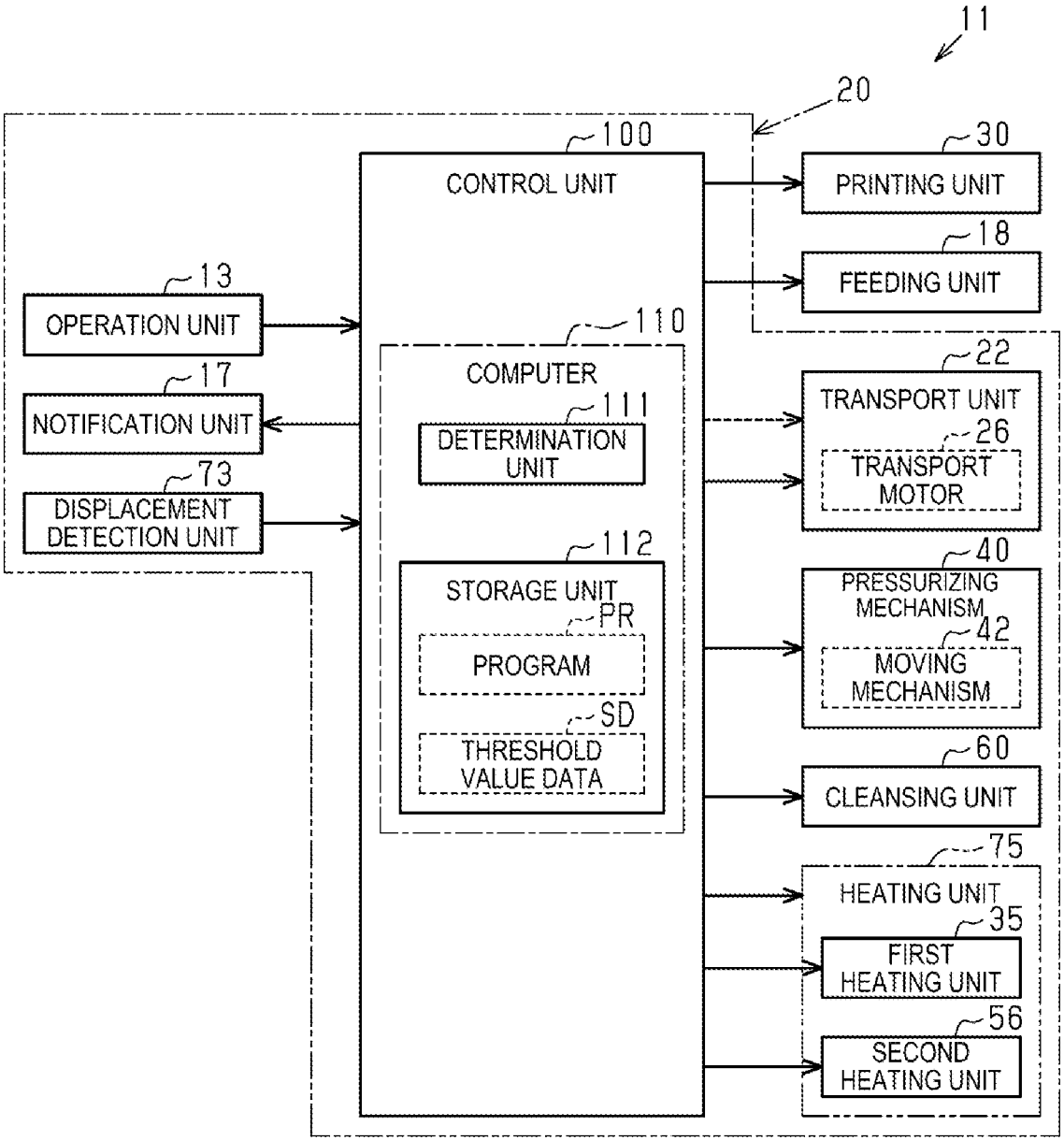
FIG. 7 is a block diagram illustrating an electrical configuration of the printing apparatus.

The control unit 100 includes a computer 110 (see FIG. 7). The computer 110 is configured by including a Central Processing Unit (CPU), which is omitted in illustration, and a memory. The CPU is an arithmetic processing device. The memory is a storage device that secures an area for storing a program of the CPU, a work area, and the like, and includes a storage element such as a Random Access Memory (RAM), an Electrically Erasable Programmable Read Only Memory (EEPROM), a storage, and the like. The CPU controls an operation of each of the units of the printing apparatus 11 in accordance with the program stored in the memory.

Configuration of Pressurizing Mechanism 40

Figure 3:
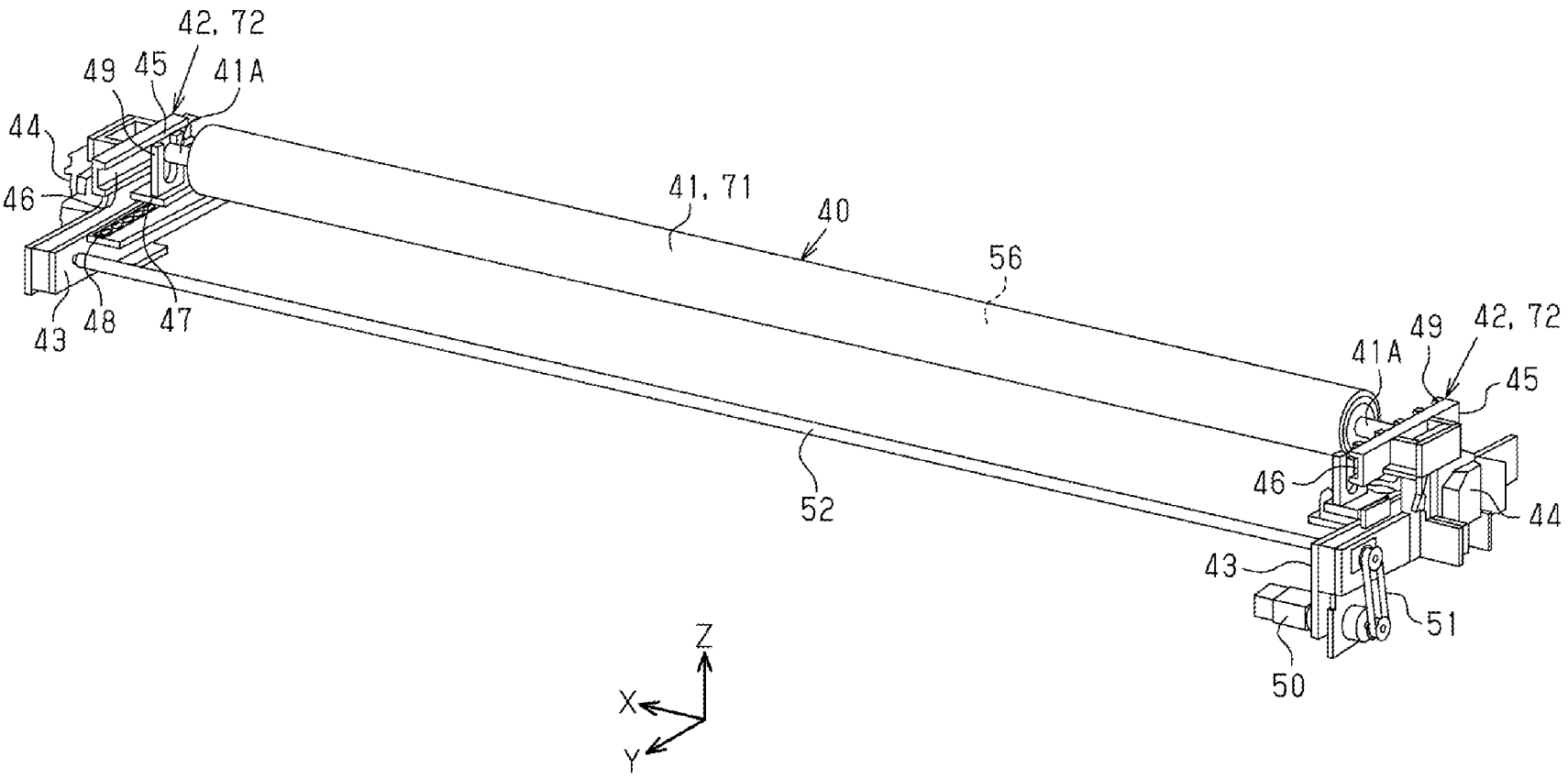
FIG. 3 is a perspective view illustrating a pressurizing mechanism.
Figure 4:
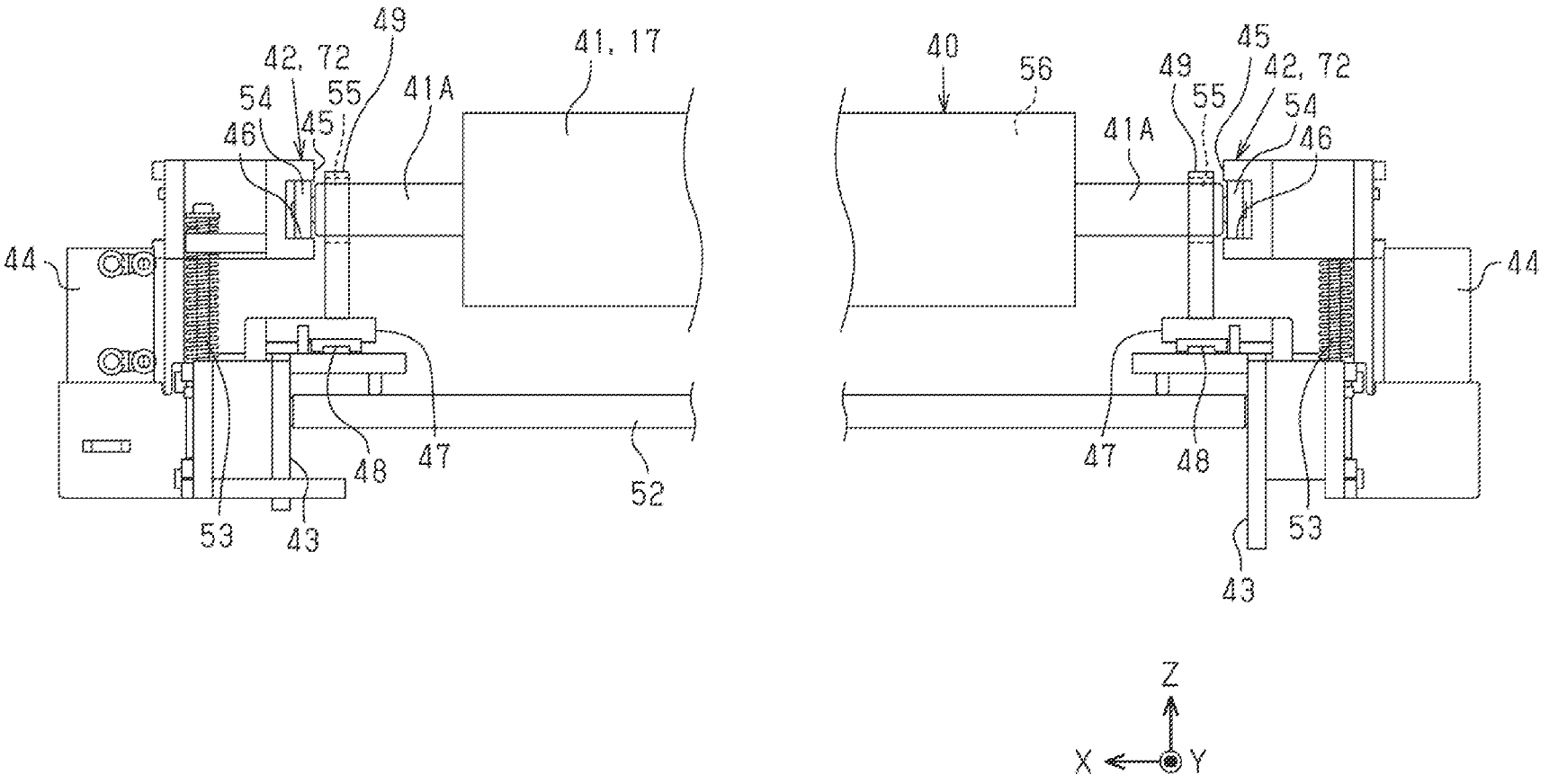
FIG. 4 is a partially-broken front view illustrating the pressurizing mechanism.

Next, with reference to FIG. 3 and FIG. 4, the configuration of the pressurizing mechanism 40 is described in detail.

As illustrated in FIG. 3, the pressurizing mechanism 40 includes the pressurizing roller 41 and the moving mechanisms 42 forming a pair, which rotatably support the pressurizing roller 41 in a movable manner in the first direction DR1 and the second direction DR2. The pressurizing mechanism 40 includes a frame 43 fixed to the housing 12 that supports the transport unit 22. The pair of moving mechanisms 42 are assembled to the frame 43. The pair of moving mechanisms 42 are driven in an interlocking manner to each other, and thus are capable of moving the pressurizing roller 41 in the first direction DR1 and the second direction DR2 while maintaining a horizontal state. Each of the pair of moving mechanisms 42 includes the moving unit 44. The moving unit 44 is configured by, for example, an air cylinder. The moving unit 44 supports a first guide unit 45 in a vertically movable manner. the first guide unit 45 supports a shaft portion 41A on each side of the pressurizing roller 41 in the width direction X in a rotatable state. In other words, the pressurizing roller 41 vertically moves while maintaining a horizontal posture by synchronizing the pair of moving units 44 to vertically move the respective shaft portions 41A.

The first guide unit 45 includes the rail unit 46 that guides the shaft portion 41A in a movable manner in the transport direction Y. The shaft portion 41A of the pressurizing roller 41 is supported in a rolling manner in a state in which the shaft portion 41A is engaged into a groove portion of the rail unit 46.

Further, at a portion of the frame 43, which is below the shaft portion 41A of the pressurizing roller 41, a slider 47 is provided in a movable manner via a linear guide 48 in the transport direction Y. The slider 47 is configured to be capable of reciprocating in the +Y direction and the −Y direction within a predetermined range in the transport direction Y. The slider 47 includes a second guide unit 49 that guides the shaft portion 41A of the pressurizing roller 41 in a vertically displaceable manner. The second guide unit 49 has a U-shaped guide groove, and the shaft portion 41A is vertically displaceable with respect to the second guide unit 49 along the guide groove.

A motor 50 being a driving source of the slider 47 is fixed to the frame 43. A driving source of the motor 50 is transmitted to the slider 47 via a driving force transmitting mechanism 51, and the transmitted force moves the slider 47 in the transport direction Y via a belt-type moving mechanism, which is omitted in illustration. Further, a rotation force transmitted from the motor 50 via the driving force transmitting mechanism 51 is transmitted from one of the moving mechanisms 42 to the other one of moving mechanisms 42 via a transmission shaft 52. The slider 47 forming the other one of moving mechanisms 42 uses, as a driving force, a rotation force transmitted via the transmission shaft 52, and thus moves in the transport direction Y via the belt-type moving mechanism, which is omitted in illustration. With this, the pressurizing roller 41 is reciprocable in the transport direction Y while maintaining a posture in which the axial direction thereof is parallel to the width direction X. When the control unit 100 forwardly or reversely drives the motor 50, the slider 47 reciprocates in the transport direction Y, and thus the pressurizing roller 41 reciprocates in the transport direction Y.

As illustrated in FIG. 4, a spring 53 is mounted between the first guide unit 45 and the frame 43. With this, the first guide unit 45 that is movable in the first direction DR1 and the second direction DR2 by driving of the moving unit 44 is urged in the first direction DR1 (for example, upward) by an urging force of the spring 53. For example, when the power source of the printing apparatus 11 is turned off, the moving unit 44 loses a force of moving the first guide unit 45 in the second direction DR2, and moves in the second direction DR2 by an urging force of the spring 53. In other words, when the power source is turned off, the pressurizing roller 41 is restored to the retraction position at which the medium M is not pressed.

The shaft portion 41A is engaged into the recessed portion of the rail unit 46 of the first guide unit 45 via a first bearing 54 in a rotatable manner, is guided by the rail unit 46, and thus is supported in a movable manner in the transport direction Y. Further, the shaft portion 41A is inserted into a U-shaped recessed portion of the second guide unit 49 via a second bearing 55 in a rotatable manner, is guided in the first direction DR1 and the second direction DR2, and thus is supported in a movable manner in the transport direction Y.

Configuration of Adhesive Force Measuring Mechanism

Figure 5:
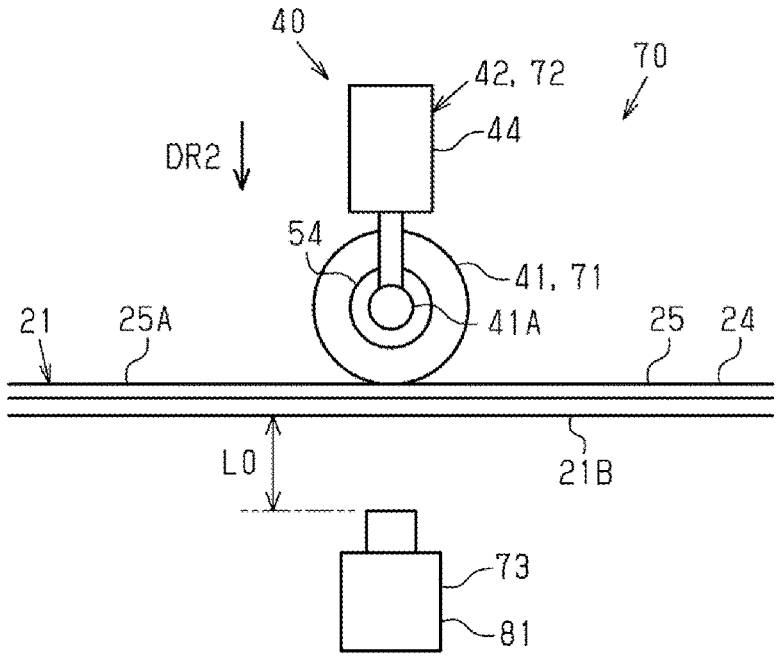
FIG. 5 is a schematic side cross-sectional view illustrating an adhesive force measuring mechanism.
Figure 6:
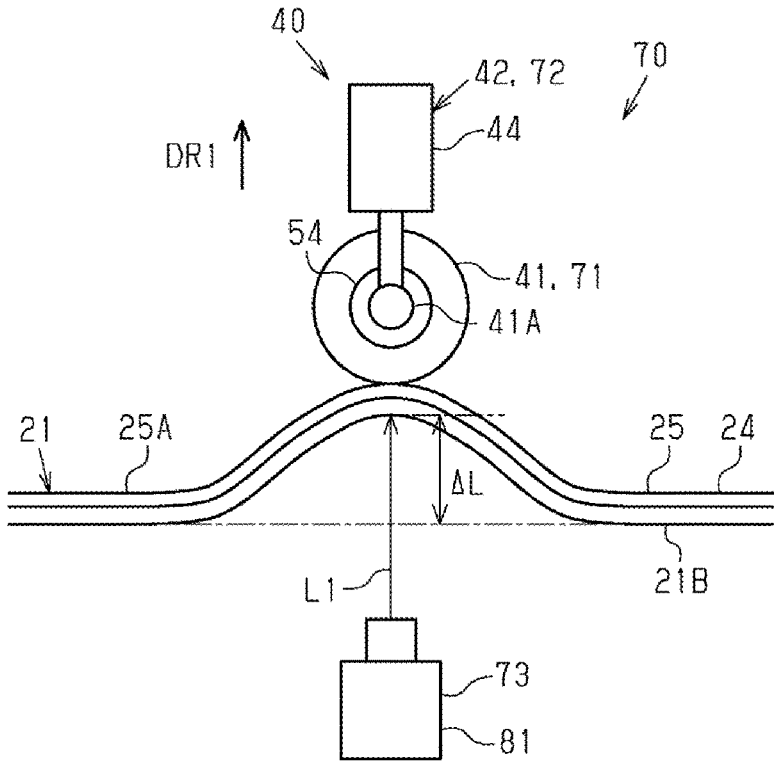
FIG. 6 is a schematic side cross-sectional view illustrating a state in which the adhesive force measuring mechanism measures an adhesive force.

Next, with reference to FIG. 5 and FIG. 6, description is made on an adhesive force measuring mechanism 70 that measures an adhesive force of the adhesive layer 25 through use of the abutting unit 71.

As illustrated in FIG. 5, the adhesive force measuring mechanism 70 includes the abutting unit 71, a moving mechanism 72, and a displacement detection unit 73. The abutting unit 71 is configured to be capable of abutting against the surface 25A of the adhesive layer 25. The moving mechanism 72 is a mechanism that moves the position of the abutting unit 71 with respect to the surface 25A in the first direction DR1 and the second direction DR2. The moving mechanism 72 is capable of moving the abutting unit 71 between an abutting position in FIG. 5 at which the abutting unit 71 abuts against the surface 25A and the retraction position (omitted in illustration) at which the abutting unit 71 moves in the first direction DR1 from the abutting position and is away from the surface 25A by a predetermined distance.

The displacement detection unit 73 detects a displacement amount of the transport belt 21 in the first direction DR1. The displacement amount is generated when the moving mechanism 72 moves the abutting unit 71 in the first direction DR1 while the abutting unit 71 abuts against the surface 25A. The displacement detection unit 73 detects a displacement amount ΔL of the transport belt 21 in the first direction DR1 in a non-contact manner. As illustrated in FIG. 5, the displacement detection unit 73 is arranged at a position opposite to the abutting unit 71 across the transport belt 21 (the lower side in FIG. 5). The displacement detection unit 73 is positioned below the back surface of the transport belt 21 by a predetermined distance. The displacement detection unit 73 illustrated in FIG. 5 and FIG. 6 is a distance sensor 81, for example. The distance sensor 81 measures a distance to the back surface of the transport belt 21.

Further, in the present exemplary embodiment, the pressurizing roller 41 is used as the abutting unit 71. Further, the moving mechanism 42 is a mechanism that moves the pressurizing roller 41 in an intersecting direction (for example, the vertical direction Z) intersecting with the surface 25A, and is used as the moving mechanism 72 forming the adhesive force measuring mechanism 70. In the following description, an example is given by assuming that the abutting unit 71 is used as the pressurizing roller 41 and the moving mechanism 72 is used as the moving mechanism 42 forming the pressurizing mechanism 40. An operation of the adhesive force measuring mechanism 70 in such an example is described.

As illustrated in FIG. 5, the moving mechanism 42 moves (lowers) the pressurizing roller 41 in the second direction DR2 from the retraction position (omitted in illustration) away from the surface 25A. With this, the abutting unit 71 is caused to abut against the adhesive layer 25 of the transport belt 21. The abutting unit 71 adheres to the surface 25A due to an adhesive force corresponding to an adhesive force of the adhesive layer 25. In this case, a force by which the pressurizing roller 41 presses the surface 25A is an own weight of the pressurizing roller 41.

Next, as illustrated in FIG. 6, the moving mechanism 42 is driven to move (raise) the pressurizing roller 41 in the first direction DR1. The transport belt 21 adheres to the outer circumferential surface of the pressurizing roller 41 due to an adhesive force of the adhesive layer 25. With this, when the pressurizing roller 41 moves in the first direction DR1, the portion of the transport belt 21 that abuts against the pressurizing roller 41 is lifted up due to an adhesive force of the adhesive layer 25. Further, when the transport belt 21 is lifted up to a certain height position, the transport belt 21 peels off from the pressurizing roller 41.

Here, the height position of the pressurizing roller 41 at which the transport belt 21 peels off from the pressurizing roller 41 is higher as an adhesive force of the adhesive layer 25 is higher. In other words, an adhesive force of the surface 25A of the adhesive layer 25 is a first adhesive force, the height position is higher with the first adhesive force as compared to a second adhesive force smaller than the first adhesive force.

For example, the displacement detection unit 73 measures a first distance L0 to the back surface of the transport belt 21 before the pressurizing roller 41 illustrated in FIG. 5 lifts up the transport belt 21, that is, before displacement. In this case, the transport belt 21 is supported on a support table 19 (see FIG. 2) positioned on the opposite side of the pressurizing roller 41 across the transport belt 21, and hence is not deformed in the second direction DR2 from the horizontal state. A through hole (omitted in illustration) and a transparent window portion that is assembled in the through hole and is formed of a material having optical transparency are formed in a part of the support table 19 within the range in which the pressurizing roller 41 moves in the transport direction Y. The distance sensor 81 being an example of the displacement detection unit 73 measures the distance to the back surface of the transport belt 21 through this window portion.

Here, the transparent window portion is mounted in the support table 19 so as to have an upper surface that is substantially flush with the upper surface of the support table 19. With this, the medium M is supported on the upper surface of the support table 19 without a level difference even at the position corresponding to the window portion. Further, the window portion is formed of a transparent material having high optical transparency with respect to light (for example, laser light) used by the distance sensor 81 for distance measurement.

As illustrated in FIG. 6, when the pressurizing roller 41 moves in the first direction DR1 from the abutting position illustrated in FIG. 5, and lifts up the transport belt 21 due to an adhesive force of the adhesive layer 25, the distance sensor 81 measures a second distance L1 to the back surface of the transport belt 21. The information relating to the distances L0 and L1, which is the measurement result obtained by the distance sensor 81, is transmitted to the control unit 100. The control unit 100 detects a difference between the first distance L0 and the second distance L1 as the displacement amount ΔL. The displacement amount ΔL is calculated from the expression ΔL=L1−L0. Note that there may be adopted a configuration in which the distance sensor 81 acquires the displacement amount ΔL corresponding to the difference between the first distance L0 and the second distance L1 and transmits the information relating to the displacement amount ΔL to the control unit 100.

Electrical Configuration of Printing Apparatus 11

Next, an electrical configuration of the printing apparatus 11 is described with reference to FIG. 7.

As illustrated in FIG. 7, the constituent elements of the printing unit 30, the feeding unit 18, and the transport device 20 are electrically coupled to the control unit 100. The transport device 20 includes, as the constituent elements controlled by the control unit 100, the transport unit 22, the pressurizing mechanism 40, the cleansing unit 60, and a heating unit 75 that are illustrated in FIG. 7. The control targets that are electrically coupled to the control unit 100 are as described below.

The control unit 100 controls the ejection unit 31 forming the printing unit 30 and a feeding motor (omitted in illustration) being a driving source of the feeding unit 18. When the printing unit 30 is a serial printing type, the control unit 100 further controls a carriage motor (omitted in illustration) being a driving source of the carriage 32.

Further, the control unit 100 controls each of the transport motor 26 being a driving source of the transport unit 22, the driving source of the moving mechanism 42 forming the pressurizing mechanism 40, the driving source of the cleansing unit 60, and the first heating unit 35 and the second heating unit 56 that form the heating unit 75. As the driving sources of the moving mechanism 42, the moving unit 44 (cylinder) and the motor 50 (see FIG. 3 for both the components) are provided. As the driving sources of the cleansing unit 60, the cylinders 66 forming the lifting and lowering mechanism 65 and a motor (omitted in illustration) being a driving source for rotating the brush 62 are provided.

The heating unit 75 heats the adhesive layer 25 in a pressurizing region in which the pressurizing roller 41 pressurizes the surface 25A of the adhesive layer 25 or at a position upstream of the pressuring region in the circling direction CD of the transport belt 21. The heating unit 75 in this example heats the adhesive layer 25 both in the pressurizing region of the surface 25A of the adhesive layer 25 and at the position upstream the transport belt 21 in the circling direction CD. Thus, the heating unit 75 includes the first heating unit 35 and the second heating unit 56. The first heating unit 35 heats the surface 25A of the transport belt 21 at the heating position upstream of the pressurizing region of the pressurizing roller 41 (see FIG. 2) in the circling direction CD. The second heating unit 56 heats the pressurizing roller 41. The pressurizing roller 41 heated by the second heating unit 56 heats the pressurizing region of the surface 25A of the adhesive layer 25.

When the control unit 100 is determined that the adhesive layer 25 of a heat-sensitive type is degraded, a heating temperature for at least one of the first heating unit 35 and the second heating unit 56 is raised. With this, even when the adhesive layer 25 of a heat-sensitive type is degraded, a necessary adhesive force can be applied to the part of the adhesive layer 25, which corresponds to the pressurizing region of the pressurizing roller 41.

Further, the operation unit 13 and the notification unit 17 are electrically coupled to the control unit 100. For example, the notification unit 17 is formed of at least one of the display unit 14 and a sound generator (omitted in illustration). The display unit 14 may be used as the notification unit 17. The display unit 14 may have a notification function of issuing a notification of information through display.

The control unit 100 to which an operation signal is input from the operation unit 13 operated by a user receives printing condition information required for printing or the like input from a user, instruction information instructed by a user with respect to the printing apparatus 11, or the like. Further, the control unit 100 causes the notification unit 17 to notify a user or the like of information relating to an adhesive layer degradation determination result. When the notification unit 17 is the display unit 14, the display unit 14 is caused to display information such as a message containing the adhesive layer degradation determination result. When the notification unit 17 is a sound generator, the control unit 100 causes the sound generator to issue a notification of information such as a message containing the adhesive layer degradation determination result in a form of sound guidance. Note that the control unit 100 causes the display unit 14 to display a menu screen and information relating to printing, such as a printing progress state.

The control unit 100 includes the computer 110. The computer 110 includes a determination unit 111 and a storage unit 112.

The control unit 100 determines the adhesive layer 25 is degraded to such a degree that a required adhesive force cannot be obtained, based on the displacement amount ΔL detected by the displacement detection unit 73. The control unit 100 includes the determination unit 111 for performing this determination. When the determination unit 111 determines that the adhesive layer 25 is degraded, the control unit 100 causes the notification unit 17 to issue a notification of the information indicating that the adhesive layer 25 is degraded. For example, when the notification unit 17 is the display unit 14, the control unit 100 causes the display unit 14 to display information such as a message indicating that the adhesive layer 25 is degraded. Further, when the notification unit 17 is a sound generator such as a speaker, the control unit 100 causes the sound generator to generate sound information for announcing that the adhesive layer 25 is degraded. Note that the sound generator may be caused to generate an alarming sound, such as a buzzer and a chime, indicating that the adhesive layer 25 is degraded.

Figure 10:
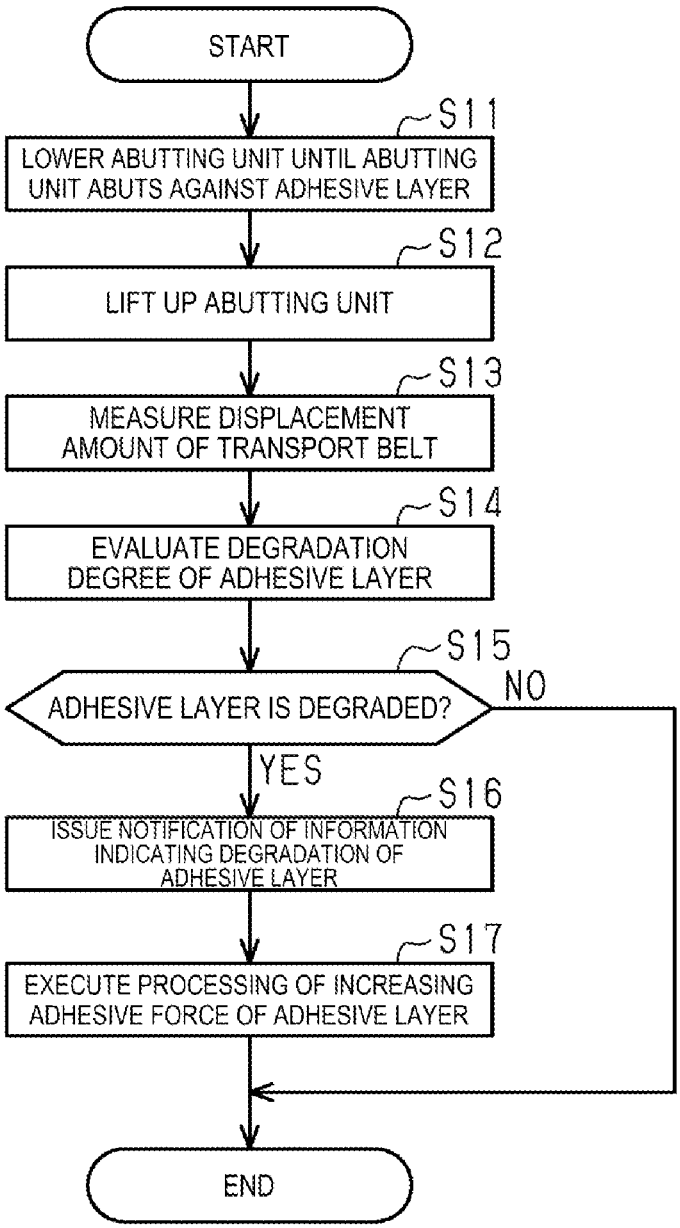
FIG. 10 is a flowchart illustrating the adhesive layer degradation determination processing.

As illustrated in FIG. 7, the storage unit 112 stores a program PR. The program PR includes at least the program illustrated in the flowchart of FIG. 10. The computer 110 in the control unit 100 executes the program PR, and thus adhesive layer degradation determination processing illustrated in FIG. 10 is executed. The storage unit 112 stores threshold value data SD required for the adhesive layer degradation determination processing.

Here, the displacement amount ΔL when the transport belt 21 peels off from the pressurizing roller 41, that is, a maximum displacement amount ΔLmax is substantially proportional to an adhesive force of the surface 25A of the adhesive layer 25. Further, when the maximum displacement amount ΔLmax is detected, a degree to which the adhesive layer 25 is degraded (degradation degree) can be evaluated.

Further, with reference to the threshold value data SD (see FIG. 8), the control unit 100 is capable of determining whether an adhesive force of the surface 25A of the adhesive layer 25 is degraded to fall below a threshold value. For example, a threshold value SH of the displacement amount ΔL corresponding to the threshold value of the adhesive force is obtained in advance through a preliminary experiment, a calculation on simulation, or the like. When the displacement amount ΔL measured by the distance sensor 81 and the threshold value SH are compared with each other, it can be determined whether the adhesive layer 25 is degraded to have an adhesive force below the threshold value.

Threshold Value Data SD

Figures 8, 9:
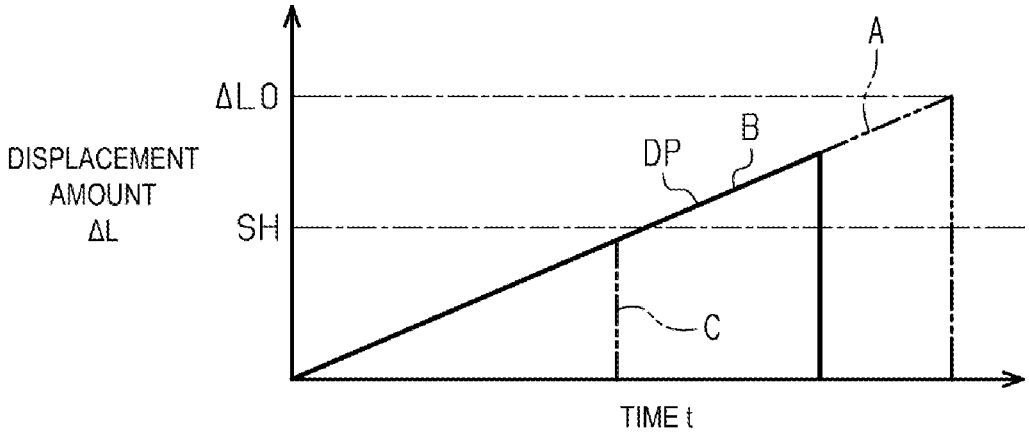
FIG. 8 is a diagram illustrating threshold value data.
FIG. 9 is a graph describing adhesive layer degradation determination processing.

Next, with reference to FIG. 8, the threshold vale data SD is described. The threshold value data SD illustrated in FIG. 8 is the threshold value data SD, assuming that the medium M is fabric. As illustrated in FIG. 8, in the threshold value data SD, the threshold value SH is set for each fabric type. For example, in the threshold value data Sd, a threshold value SH1, a threshold value SH2, . . . , and a threshold value SHn are set for first fabric, second fabric, . . . , and n-th fabric, respectively. When information relating to a fabric type contained in the printing condition information is received from the operation unit 13, the control unit 100 selects the threshold value SH in accordance with the corresponding fabric type with reference to the threshold value data SD.

The threshold value SH may be the displacement amount ΔL that is determined in advance before shipping of the printing apparatus 11. Further, the threshold value SH may be the displacement amount ΔL directly before a user replaces the adhesive layer 25. In the latter case, at timing directly before replacing the adhesive layer 25, a user operates the operation unit 13, and thus instructs the printing apparatus 11 to execute the adhesive layer degradation determination processing. The control unit 100 that receives the instruction executes the adhesive layer degradation determination processing. As a result of this, the obtained displacement amount ΔL is stored in a predetermined storage region of the storage unit 112, and the stored displacement amount ΔL is used as the threshold value SH.

Adhesive Layer Degradation Determination Processing

FIG. 9 is a graph for describing the adhesive layer degradation determination processing. In the graph shown in FIG. 9, the horizontal axis indicates an elapse time t when the pressurizing roller 41 moves in the first direction DR1 at a constant speed, and the vertical axis indicates the displacement amount ΔL. The line DP in the graph indicates the displacement amount ΔL when the transport belt 21 peels off from the pressurizing roller 41. As indicated with the two-dot chain line A in the graph of FIG. 9, directly after the adhesive layer 25 is replaced, the displacement amount ΔL until the transport belt 21 peels off is an initial large displacement amount ΔL0. After that, an adhesive force of the adhesive layer 25 is gradually reduced as printing is repeated. The solid line B in the graph of FIG. 9 indicates that the displacement amount ΔL until the transport belt 21 peels off still exceeds the threshold value SH. In addition, as indicated with the two-dot chain line C in the graph of FIG. 9, when an adhesive force of the adhesive layer 25 is reduced, the displacement amount ΔL when the transport belt 21 peels off is below the threshold value SH. When the displacement amount ΔL is below the threshold value SH as described above, the determination unit 111 determines that the adhesive layer 25 is degraded.

Here, the following two methods are given as a determination method for the adhesive layer 25.

(a) A determination method based on whether the displacement amount ΔL is below the threshold value SH, the displacement amount ΔL being measured by moving the pressurizing roller 41 until the transport belt 21 peels off.

(b) A determination method based on whether peeling occurs while moving the pressurizing roller 41 until the displacement amount ΔL is equal to the threshold value SH.

In the first method (a), when the maximum displacement amount ΔL when the transport belt 21 peels off is below the threshold value SH, the control unit 100 determines that the adhesive layer 25 is degraded. Further, in the second method (b), in a case in which the pressurizing roller 41 moves to such a height that the displacement amount ΔL is equal to the threshold value SH, when the lifted transport belt 21 peels off from the pressurizing roller 41, the control unit 100 determines that the adhesive layer 25 is degraded.

Actions of Exemplary Embodiment

Next, description is made of effects of the transport device 20 and the printing apparatus 11 according to this exemplary embodiment.

A user operates the operation unit 13, and thus instructs execution of the adhesive layer degradation determination processing. The determination processing may be executed before the medium M is set on the transport belt 21, or may be executed in a state in which the medium M is not on the transport belt 21 after printing is completed. The adhesive layer degradation determination processing is processing for determining whether an adhesive force of the adhesive layer 25 during printing is appropriate, that is, whether the adhesive layer 25 is degraded. Thus, the adhesive layer degradation determination processing is basically executed with heating under a heating condition during printing. However, the adhesive layer degradation determination processing may be executed at a normal temperature. Note that, when the processing is executed at a normal temperature, reference data indicating a relationship between a temperature and an adhesive force for each material of the adhesive layer 25 is acquired in advance through a preliminary experiment, simulation, or the like, and is stored in the storage unit 112. Further, the measured displacement amount ΔL may be converted into the displacement amount ΔL at a heating temperature during printing, with reference to the reference data, and the converted displacement amount ΔL may be used to determined degradation of the adhesive layer 25.

When an instruction signal that instructs execution of the adhesive layer degradation determination processing is input from the operation unit 13, the control unit 100 executes the adhesive layer degradation determination processing illustrated in FIG. 10. Note that, before execution of the adhesive layer degradation determination processing executed without presence of the medium M, it is assumed that the pressurizing roller 41 is present at the retraction position away from the adhesive layer 25 in the first direction DR1.

First, in Step S11, the control unit 100 lowers the abutting unit 71 until the abutting unit 71 abuts against the adhesive layer 25. In other words, the control unit 100 controls the moving mechanism 42, and thus moves the pressurizing roller 41 in the second direction DR2 from the retraction position to the abutting position of abutting against the surface 25A of the adhesive layer 25. As a result, as illustrated in FIG. 5, the pressurizing roller 41 abutting against the surface 25A is pressed against the surface 25A of the transport belt 21 with an own weight as a load.

In Step S12, the control unit 100 raises the pressurizing roller 41. In other words, the control unit 100 controls the moving mechanism 42, and thus moves the pressurizing roller 41 in the first direction DR1 from the abutting position. As illustrated in FIG. 6, when the pressurizing roller 41 moves in the first direction DR1, the transport belt 21 adhering to the pressurizing roller 41 is lifted up. As a result, the lifted-up part of the transport belt 21 is displaced in the first direction DR1.

In Step S13, the control unit 100 measures the displacement amount ΔL of the transport belt 21. In other words, the control unit 100 controls the displacement detection unit 73, and thus measures the displacement amount ΔL of the transport belt 21. When the displacement detection unit 73 is the distance sensor 81, the distance sensor 81 measures the second distance L1 to the back surface of the transport belt 21 lifted up by the pressurizing roller 41. The control unit 100 acquires the displacement amount ΔL (=L1−L0) by subtracting the first distance L0 to the back surface of the transport belt 21 before the lift-up from the second distance L1 measured by the distance sensor 81.

In Step S14, the control unit 100 evaluates a degradation degree of the adhesive layer. In this example, when the medium M is fabric, the control unit 100 refers to the threshold value data SD read from the storage unit 112, based on a corresponding fabric type selected by a user, and acquires the threshold value SH in accordance with the fabric type. Further, the control unit 100 uses the first method (a) or the second method (b), and thus evaluates a degradation degree of the adhesive layer 25 through use of the threshold value SH. The distance sensor 81 is capable of continuously measuring the displacement amount ΔL of the transport belt 21, and hence any method of the first method (a) and the second method (b) may be adopted.

In other words, in the first method (a), the displacement detection unit 73 measures the displacement amount ΔL when the transport belt 21 peels off from the pressurizing roller 41 raised at a constant speed, and it is determined whether the displacement amount ΔL is below the threshold value SH. When the displacement amount ΔL is not below the threshold value SH, the control unit 100 evaluates that the adhesive layer 25 is not degraded. In contrast, when the displacement amount ΔL is below the threshold value SH, the control unit 100 evaluates that the adhesive layer 25 is degraded.

Further, in the second method (b), the control unit 100 moves the pressurizing roller 41 in the first direction DR1 until the displacement amount ΔL is equal to the threshold value SH, and determines whether the transport belt 21 peels off. When the transport belt 21 does not peel off, the control unit 100 evaluates that the adhesive layer 25 is not degraded. In contrast, when the transport belt 21 peels off, the control unit 100 evaluates that the adhesive layer 25 is degraded.

In Step S15, the control unit 100 determines whether the adhesive layer 25 is degraded. In a case in which the transport belt 21 peels off from the pressurizing roller 41, when the displacement amount ΔL is equal to or greater than the threshold value SH based on the evaluation result, the control unit 100 determines that the adhesive layer 25 is not degraded. In contrast, in a case in which the transport belt 21 peels off from the pressurizing roller 41, when the displacement amount ΔL is below the threshold value SH based on the evaluation result, the control unit 100 determines that the adhesive layer 25 is degraded.

In Step S16, the control unit 100 issues a notification of the information indicating that the adhesive layer 25 is degraded. The control unit 100 causes the notification unit 17 to issue a notification of the information indicating that the adhesive layer 25 is degraded. When the notification unit 17 is the display unit 14, the control unit 100 causes the display unit 14 to display a message indicating "Replace the adhesive layer", for example. Further, when the notification unit 17 is a sound generator, the control unit 100 causes the sound generator to generate an announcement indicating "Replace the adhesive layer", for example.

In Step S17, the control unit 100 executes processing for increasing an adhesive force of the adhesive layer 25. In this example in which the adhesive layer 25 is a heat-sensitive type, the control unit 100 adjusts a temperature of the adhesive layer 25 heated by the heating unit 75, based on the determination result indicating whether the adhesive layer 25 is degraded. The control unit 100 raises a heating temperature of the heating unit 75, and thus obtains a higher adhesive force of the adhesive layer 25. Thus, even when the adhesive layer 25 is degraded, the medium M can be caused to adhere to the surface 25A of the adhesive layer 25 with a required adhesive force. In this case, the control unit 100 may increase a temperature of the adhesive layer 25 by increasing a heating temperature of the first heating unit 35, or may increase a temperature of the adhesive layer 25 in the pressurizing region of the pressurizing roller 41 by increasing a heating temperature of the second heating unit 56 and increasing a temperature of the pressurizing roller 41. Note that heating temperatures of both the first heating unit 35 and the second heating unit 56 may be increased together. Further, adjustment of a temperature of the adhesive layer 25 may be performed when the adhesive layer 25 is a pressure-sensitive type.

In contrast, when the adhesive layer 25 is a pressure-sensitive type, the control unit 100 causes the moving mechanism 42 to adjust a position of the pressurizing roller 41 with respect to the adhesive layer 25, based on the determination result indicating whether the adhesive layer 25 is degraded. With this, a pressure of the pressurizing roller 41 with respect to the adhesive layer 25 is adjusted. When it is determined that the adhesive layer 25 is degraded, the control unit 100 causes the moving mechanism 42 to adjust a position of the pressurizing roller 41 with respect to the adhesive layer 25 in the second direction DR2. As a result, a pressure with which the pressurizing roller 41 presses the adhesive layer 25 is increased, and an adhesive force of the adhesive layer 25 is increased by an amount of the increased pressure. Note that adjustment of a pressure of the pressurizing roller 41 with respect to the adhesive layer 25 may be performed when the adhesive layer 25 is a heat-sensitive type. Even when the adhesive layer 25 is a heat-sensitive type, a pressure of the pressurizing roller 41 with respect to the adhesive layer 25 is adjusted. With this, a degree to which the medium M is brought into close contact with the adhesive layer 25 is adjusted. As a result, an effect similar to increase of an adhesive force of the adhesive layer 25 can be exerted.

As described above, when it is determined that the adhesive layer 25 is degraded, material characteristics of the adhesive forming the adhesive layer 25 of a heat-sensitive type or the adhesive layer 25 of a pressure-sensitive type are utilized, and a temperature or a pressure applied to the adhesive layer 25 is increased more than a set heating temperature that is set in accordance with a type of the medium M (for example, fabric). Thus, printing with high quality can be continues until the adhesive layer 25 is replaced.

Thus, a user who sees the information indicating that the adhesive layer 25 is degraded, the message that suggests replacement of the adhesive layer 25, and the like stops an operation of the printing apparatus 11, and replaces the adhesive layer 25 that has been used with a new adhesive layer 25. For example, a user replaces the adhesive layer 25 by performing an operation such as removal of the adhesive layer 25 from the transport belt 21, application of a new adhesive on the surface of the belt base material 21B, and the like.

Effects of Exemplary Embodiment

According to the exemplary embodiment, the following effects can be obtained.

(1) The transport device 20 includes the transport belt 21, the abutting unit 71, the moving mechanism 72, and the displacement detection unit 73. The transport belt 21 has the adhesive layer 25 capable of adhering to the medium M, and is capable of transporting the medium M adhering to the adhesive layer 25. The abutting unit 71 is capable of abutting against the surface 25A of the adhesive layer 25. It is assumed that the direction in which the abutting unit 71 is away from the adhesive layer 25 is the first direction DR1 and the direction being the direction opposite to the first direction DR1 and the direction in which the abutting unit 71 approaches the adhesive layer 25 is the second direction DR2. The moving mechanism 72 is capable of moving the position of the abutting unit 71 with respect to the surface 25A in the first direction DR1 and the second direction DR2. The displacement detection unit 73 detects the displacement amount ΔL of the transport belt 21 in the first direction DR1. The displacement amount ΔL is generated when the moving mechanism 72 moves the abutting unit 71 in the first direction DR1 while the abutting unit 71 abuts against the surface 25A.

With this configuration, the abutting unit 71 abuts against the adhesive layer 25 of the transport belt 21, and thus adheres to the surface 25A of the adhesive layer 25. The abutting unit 71 moves in the first direction DR1 away from the transport belt 21, and thus the abutting unit 71 is caused to peel off from the surface 25A of the adhesive layer 25. The displacement detection unit 73 detects the displacement amount ΔL of the transport belt 21 in the first direction DR1 during this process, and thus an adhesive force of the adhesive layer 25 is detected. With this, as compared to a case in which an adhesive force is detected through sliding in the direction along the surface 25A of the adhesive layer 25 (the transport direction Y/the width direction X), the adhesive layer 25 is less worn, and rapid degradation of the adhesive layer 25 (reduction of an adhesive force) can be suppressed. Thus, sliding friction between the abutting unit 71 and the transport belt 21 is suppressed at the time of detecting presence or absence of degradation of the adhesive layer 25. Thus, presence or absence of degradation of the adhesive layer 25 can be detected while suppressing rapid degradation of the adhesive layer 25.

(2) The displacement detection unit 73 detects the displacement amount ΔL of the transport belt 21 in the first direction DR1 in a non-contact manner. With this configuration, the displacement detection unit 73 is capable detecting the displacement amount ΔL of the transport belt 21 in a non-contact manner, and hence degradation of the adhesive layer 25 can be suppressed more than contact-type detection.

(3) The abutting unit 71 is the pressurizing roller 41 that presses the medium M against the adhesive layer 25. With this configuration, the pressurizing roller 41 is used as the abutting unit 71. Thus, the displacement amount ΔL of the transport belt 21 in the first direction DR1 can be detected with a simple configuration.

(4) The transport device 20 includes the control unit 100 that determines whether the adhesive layer 25 is degraded, based on the displacement amount ΔL detected by the displacement detection unit 73, and the notification unit 17 that issues a notification of information. When it is determined that the adhesive layer 25 is degraded, the control unit 100 causes the notification unit 17 to issue a notification of the information indicating that the adhesive layer 25 is degraded. With this configuration, a user is allowed to sense degradation of the adhesive layer 25 in an objective manner.

(5) The adhesive layer 25 is formed of an adhesive having a higher adhesive force as a temperature is higher. The transport device 20 includes the heating unit 75 that heats the adhesive layer 25 in the pressurizing region in which the pressurizing roller 41 pressurizes the surface 25A of the adhesive layer 25 or at the position upstream of the pressuring region in the circling direction CD of the transport belt 21. The control unit 100 adjusts a temperature of the adhesive layer 25 heated by the heating unit 75, based on the determination result indicating whether the adhesive layer 25 is degraded. With this configuration, a temperature of the adhesive layer 25 is increased, and thus an adhesive force of the degraded adhesive layer 25 can be temporarily increased.

(6) The adhesive layer 25 is formed of an adhesive having a higher adhesive force as a pressure is higher. The control unit 100 causes the moving mechanism 72 to adjust a position of the pressurizing roller 41 with respect to the adhesive layer 25, based on the determination result indicating whether the adhesive layer 25 is degraded. With this, a pressure of the pressurizing roller 41 with respect to the adhesive layer 25 is adjusted. With this configuration, a pressure with respect to the adhesive layer 25 is increased, and thus an adhesive force of the degraded adhesive layer 25 can be temporarily increased.

(7) The printing apparatus 11 includes the transport belt 21, the printing unit 30, the abutting unit 71, the moving mechanism 72, and the displacement detection unit 73. The printing unit 30 performs printing on the medium M transported by the transport belt 21, through use of the transport belt 21 that has the adhesive layer 25 capable of adhering to the medium M and is capable of transporting the medium M adhering to the adhesive layer 25. The abutting unit 71 is capable of abutting against the surface 25A of the adhesive layer 25. The moving mechanism 72 is capable of moving the position of the abutting unit 71 with respect to the surface 25A in the first direction DR1 and the second direction DR2. The displacement detection unit 73 detects the displacement amount ΔL of the transport belt 21 in the first direction DR1. The displacement amount ΔL is generated when the moving mechanism 72 moves the abutting unit 71 in the first direction DR1 while the abutting unit 71 abuts against the surface 25A. With this configuration, in the printing apparatus 11, sliding friction between the abutting unit 71 and the transport belt 21 is suppressed at the time of detecting presence or absence of degradation of the adhesive layer 25. Thus, presence or absence of degradation of the adhesive layer 25 can be detected while suppressing rapid degradation of the adhesive layer 25.

Second Exemplary Embodiment

Figure 11:
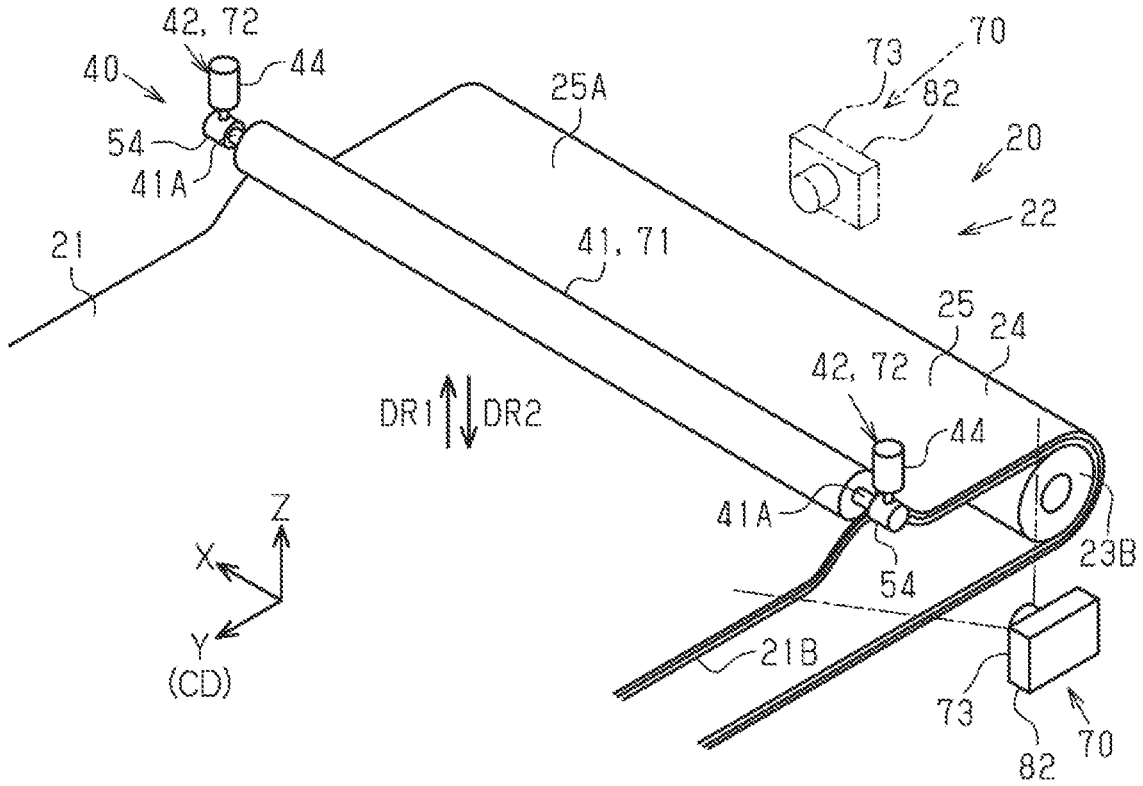
FIG. 11 is a schematic side cross-sectional view illustrating an adhesive force measuring mechanism in a second exemplary embodiment.
Figure 12:
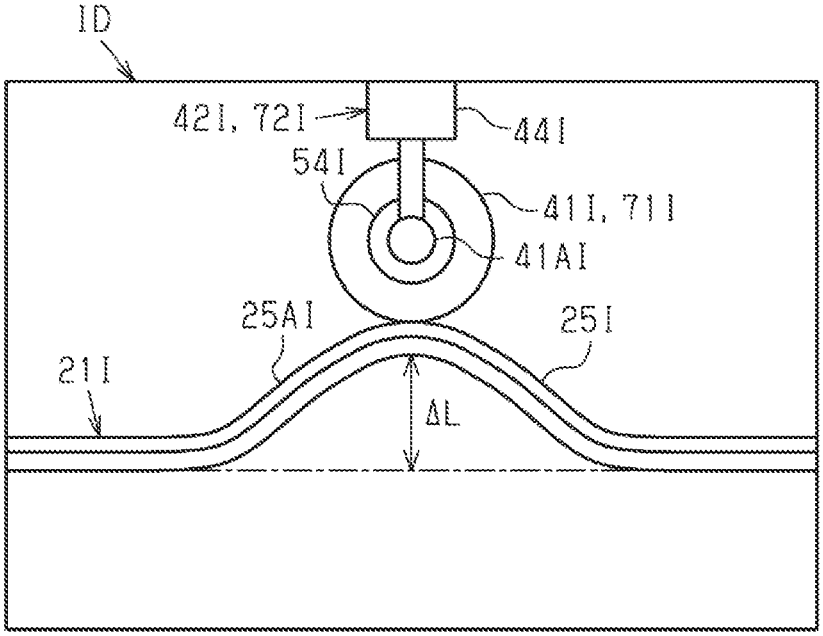
FIG. 12 is a schematic view illustrating an image captured by a camera of the adhesive force measuring mechanism.

Next, with reference to FIG. 11 and FIG. 12, a second exemplary embodiment is described. The basic configuration of the printing apparatus 11 is similar to that in the first exemplary embodiment described above. A difference from the first exemplary embodiment is that the transport device 20 uses a camera 82 as the displacement detection unit 73.

In FIG. 11, the moving mechanisms 42 are similar to those in the first exemplary embodiment described above, and the pair of moving units 44 are provided. The pair of moving units 44 move the position of the abutting unit 71 with respect to the surface 25A in the first direction DR1 and the second direction DR2. Similarly to the first exemplary embodiment, the abutting unit 71 is the pressurizing roller 41.

As illustrated in FIG. 11, for example, the displacement detection unit 73 may be the camera 82. The camera 82 captures an image of a side end of the transport belt 21 in the width direction X along the axial direction of the pressurizing roller 41. The camera 82 acquires an image ID (see FIG. 12) obtained by viewing the transport belt 21 from a side. Specifically, an imaging height of the camera 82 matches with a height position of the back surface of the transport belt 21. The camera 82 captures a region in which a part of the transport belt 21, which is lifted up by the pressurizing roller 41, is positioned at the center of the width of the captured region and an entire part of the transport belt 21, which is displaced in the first direction DR1, is fitted in the captured region. Note that the camera 82 may be arranged at the position indicated with the two-dot chain line in FIG. 11. In other words, the camera 82 may be arranged at a position upstream of the transport belt 21 in the transport direction Y. The camera 82 may capture an image of the transport belt 21 from upstream to downstream in the transport direction Y. The imaging height of the camera 82 is set so as to be flush with the height of the surface 25A of the transport belt 21.

FIG. 12 illustrates the image ID captured by the camera 82. As illustrated in FIG. 12, there is captured the image ID that contains the part of the transport belt 21, which is lifted up the pressurizing roller 41, with an adhesive force of the adhesive layer 25. The members and the like shown in the image ID are denoted with "I" at the ends of the reference symbols so as to be distinguished from the actual members and the like. The image ID contains a pressurizing roller 411 used as an abutting unit 711, moving mechanisms 421 and 721, a moving unit 441, a shaft portion 41AI, a first bearing 541, a transport belt 211, an adhesive layer 251, a surface 25AI, and the like. In the image ID, the back surface of the transport belt 211 is captured as a horizontal linear line. In other words, the image ID is an image captured by the camera 82 from the height position flush with the upper surface portion 24*a* of the transport belt 21 horizontally toward the transport belt 21.

The following two methods are given as an imaging method. In a first method, the maximum displacement amount ΔLmax is detected. The camera 82 continuously acquires a plurality of images, or captures a moving image. In this case, the control unit 100 performs an image analysis for the plurality of images ID, and acquires one greatest displacement amount ΔL as the maximum displacement amount ΔLmax. The determination unit 111 determines that the adhesive layer 25 is not degraded when the maximum displacement amount ΔLmax is equal to or greater than the threshold value SH, and determines the adhesive layer 25 is degraded when the maximum displacement amount ΔLmax is less than the threshold value SH.

In a second method, the abutting unit 71 moves in the first direction DR1 to such a height position that the displacement amount ΔL is equal to the threshold value SH, and the camera 82 captures the image ID at the time when the abutting unit 71 arrives at the height position corresponding to the threshold value SH. The control unit 100 performs an image analysis for the image ID. When the transport belt 211 is in an adhering state of being lifted up by the abutting unit 711, it is determined that the adhesive layer 25 is not degraded. Meanwhile, as a result of the image analysis, when the transport belt 211 in the image ID is in a non-adhering state of peeling off from the abutting unit 711, the control unit 100 determines that the adhesive layer 25 is degraded.

The present exemplary embodiment in which the camera 82 is used as the displacement detection unit 73, the control unit 100 also executes the adhesive layer degradation determination processing illustrated in FIG. 10. The processing in Step S11, Step S12, and Step S14 to Step S17 other than Step S13 in FIG. 10 is basically similar to that in the first exemplary embodiment described above. Step S13 is different from that in the first exemplary embodiment described above in that the control unit 100 performs an image analysis for the image ID captured by the camera 82 to measure the displacement amount ΔL.

According to the second exemplary embodiment, the following effects can be exerted in addition to the effects (1) to (7) in the first exemplary embodiment described above.

(8) As the displacement detection unit 73, the camera 82 is used. The image ID captured by the camera 82 is subjected to an image analysis, and thus the displacement amount ΔL is acquired. Thus, the displacement amount ΔL can be measured in a non-contact manner.

Note that the above-described exemplary embodiment may be modified to modes as in the following modified examples. In addition, appropriate combinations of the exemplary embodiments described above and modified examples described below may be regarded as further modified examples, and the modified examples described below may be appropriately combined with each other and regarded as further modified examples.

Figure 13:
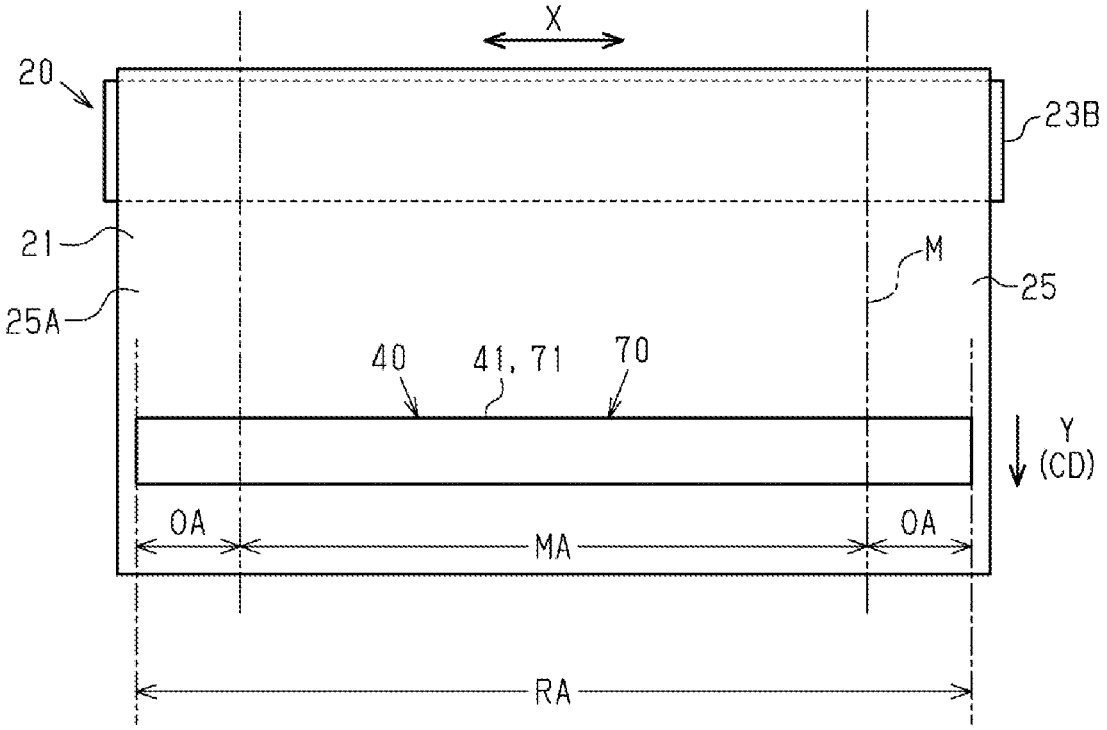
FIG. 13 is a schematic plan view illustrating an adhesive force measuring mechanism in a modified example.

The function of the pressurizing roller 41 is to suppress floating or creases by pressing down the medium M. With this, as illustrated in FIG. 13, the pressurizing roller 41 is preferably provided in the width direction X over an entire region MA to which the medium M adheres or an entire region RA larger than the region MA. In the example of FIG. 13, the region RA in which the pressurizing roller 41 abuts against the transport belt 21 is smaller than the region MA to which the medium M adheres. In other words, the region MA of the adhesive layer 25 to which the medium M adheres is a region positioned on the inner side of the region RA of the adhesive layer 25 against which the pressurizing roller 41 abuts. Thus, a region OA is present on the transport belt 21, specifically, on the outer side of the region MA in the width direction X, to which the medium M adheres. The medium M does not adhere the region OA, but the pressurizing roller 41 abuts against the region OA. When the pressurizing roller 41 is used as the abutting unit 71 of the adhesive force measuring mechanism 70, the displacement amount ΔL may be measured by causing the pressurizing roller 41 to abut against the adhesive layer 25 in the region OA on the outer side of the medium M. In this case, even when the medium M adheres to the transport belt 21, presence or absence of degradation of an adhesive force of the adhesive layer 25 can be determined.

Figure 14:
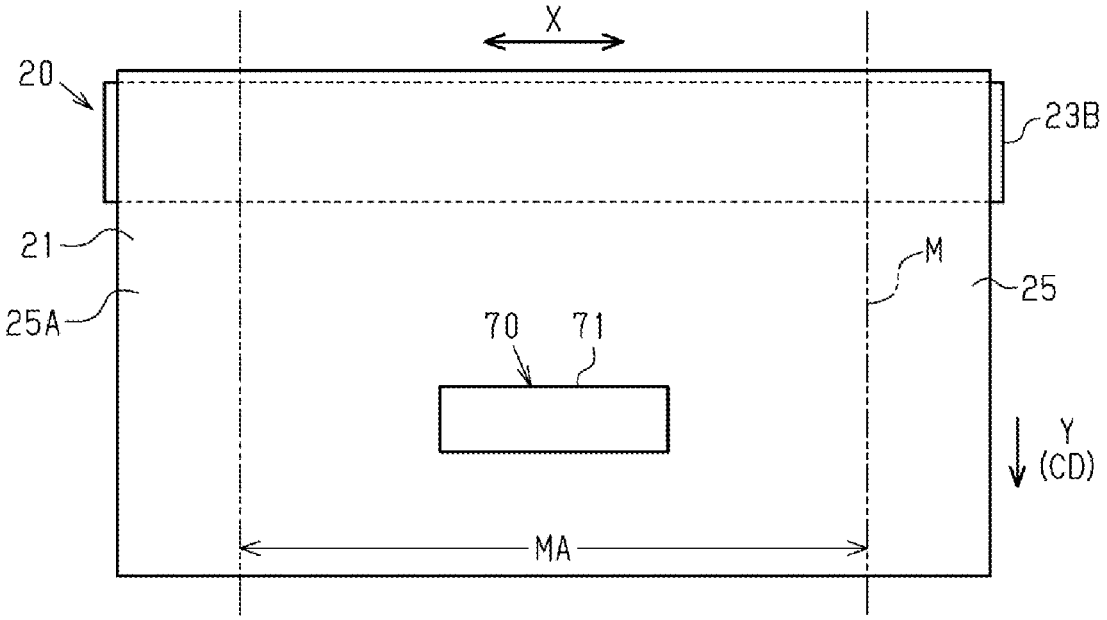
FIG. 14 is a schematic plan view illustrating an adhesive force measuring mechanism in a modified example different from that in FIG. 13.

As illustrated in FIG. 14, the abutting unit 71 of the adhesive force measuring mechanism 70 may be a member different from the pressurizing roller 41. The abutting unit 71 may be provided to the region MA to which the medium M adheres. With this configuration, presence or absence of degradation of the adhesive layer 25 in the region MA to which the medium M adheres can be determined as appropriate. In some cases, a degradation degree of the adhesive layer 25 may differ in the region MA to which the medium M adheres and the region OA to which the medium M does not adhere. In the region MA, adhering and peeling of the medium M are repeated. Moreover, a liquid such as ink and waste thread such as fluff generated from the medium M, when the medium M is fabric, easily adhere thereto. Such a liquid or waste thread may cause rapid degradation of the adhesive layer 25. Note that the abutting unit 71 different from the pressurizing roller 41 may always be mounted to the transport device 20, or may have a removable configuration in which the abutting unit 71 is mounted to the transport device 20 at the time of measurement of the displacement amount ΔL.

The abutting unit 71 may be the pressurizing roller 41 dedicated to determination. For example, when the medium M is fabric, an embossed pattern that is similar to a woven pattern of the fabric is formed on the outer circumferential surface of the pressurizing roller 41 dedicated to determination. When the displacement amount ΔL is measured, the pressurizing roller 41 for printing is replaced with the pressurizing roller 41 dedicated to determination. As compared to a case in which the pressurizing roller 41 for printing is used for determination, an adhesive force with respect to fabric can be evaluated as appropriated based on the displacement amount ΔL. Note that a plurality of pressurizing rollers 41 dedicated to determination, on which embossed patterns different for respective fabric types are formed, are prepared. There may be adopted a method of measuring the displacement amount ΔL in which one pressurizing roller 41 dedicated to determination, on which an embossed pattern is formed in accordance with a fabric type, is selected for replacement.

The abutting unit 71 may be the squeegee 63. In the example illustrated in FIG. 2, the lifting and lowering mechanism 65 that lifts up and lowers the cleansing unit 60 is used as the moving mechanism 72. In this case, a lowering direction being a direction in which the squeegee 63 being the abutting unit 71 is away from the adhesive layer 25 is the first direction DS1, and a raising direction being a direction opposite to the first direction DS1 and a direction in which the squeegee 63 approaches the adhesive layer 25 is the second direction DS2. The lifting and lowering mechanism 65 is capable of moving the position of the squeegee 63 with respect to the surface 25A in the first direction DS1 and the second direction DS2. Measurement of the displacement amount ΔL may be performed in a state in which the transport belt 21 is stopped or a state in which the transport belt 21 is driven. Further, degradation of the adhesive layer 25 may be determined in a wet process in which the surface 25A of the adhesive layer 25 is wet with the cleansing solution while performing cleansing, or degradation of the adhesive layer 25 may be determined in a dry process in which the surface 25A of the adhesive layer 25 is not wet. Further, the moving mechanism capable of lifting up and lowering the squeegee 63 independently from the reservoir tank 61 and the brush 62 may be additionally provided.

In each of the exemplary embodiments described above and the modified examples described above, presence or absence of degradation of the adhesive layer 25 is determined through comparison between the displacement amount ΔL and one threshold value SH. However, a degradation degree of the adhesive layer 25 may be determined at a plurality of steps. For example, a plurality of threshold values SH are set in accordance with degradation degrees. The control unit 100 determines which threshold value SH among the plurality of threshold values SH exceeds the displacement amount ΔL, and thus determines a degradation value in accordance with the exceeding threshold value.

The distance sensor 81 being an example of the displacement detection unit 73 may be an ultrasonic type.

The displacement detection unit 73 may be a contact-type sensor. With a configuration in which the contact-type sensor is brought into contact with the back surface of the transport belt 21, there is no risk that measurement of the displacement amount ΔL causes rapid degradation of the adhesive layer 25.

Only the first heating unit 35 that heats the surface 25A of the transport belt 21 at the position upstream of the pressurizing region of the pressurizing roller 41 in the circling direction CD may be used as the heating unit 75. Further, only the second heating unit 56 that heats the pressurizing roller 41 may be used as the heating unit 75.

Adjustment of a pressure of the pressurizing roller with respect to the adhesive layer may be performed by a transport belt moving mechanism, which is omitted in illustration, by adjusting the positions of the transport belt 21 and the adhesive layer 25 with respect to the pressurizing roller 41. The transport belt moving mechanism is a mechanism that moves the transport belt 21 together with the driving roller 23A and the driven roller 23B in the vertical direction Z, and includes, for example, the lifting and lowering mechanism that moves the driving roller 23A and the driven roller 23B in the vertical direction Z. The lifting and lowering mechanism includes, for example, a ball screw and a motor that rotatably drives the ball screw. The configuration of the lifting and lowering mechanism is not particularly limited as long as the transport belt 21 can be moved in the vertical direction Z. When it is determined that the adhesive layer 25 is degraded, the control unit 100 may cause the transport belt moving mechanism, which is omitted in illustration, to adjust the positions of the transport belt 21 and the adhesive layer 25 with respect to the pressurizing roller 41 in the first direction DR1. As a result, a pressure with which the adhesive layer 25 is pressed against the pressurizing roller 41, and an adhesive force of the adhesive layer 25 is increased by an amount of the increased pressure.

The printing apparatus 11 is not limited to a printing apparatus that performs printing on the medium M such as fabric, and may be an ink-jet printer that performs printing on the medium M such as cutform paper and roll paper. Further, the printing apparatus 11 may be a multifunction machine including the transport device 20 of a belt type.

The printing apparatus 11 is not limited to a serial printer or a line printer, and may be a lateral-type printer in which the ejection unit 31 is movable in the two directions including the width direction X and the transport direction Y.

The transport device 20 may be provided to the printing apparatus 11 of a dot impact type or to the printing apparatus 11 of a thermal transfer printing type.

Hereinafter, technical concepts that are understood from the above-described exemplary embodiments and the modified examples are described together with actions and effects thereof.

(A) A transport device includes a transport belt having an adhesive layer to which a medium is adherable and being configured to transport the medium adhering to the adhesive layer, an abutting unit configured to abut against a surface of the adhesive layer, a moving mechanism configured to move a position of the abutting unit with respect to the surface in a first direction and a second direction, the first direction being a direction in which the abutting unit is away from the adhesive layer, the second direction being a direction opposite to the first direction and a direction in which the abutting unit approaches the adhesive layer, and a displacement detection unit configured to detect a displacement amount of the transport belt in the first direction, when the moving mechanism moves the abutting unit in the first direction while the abutting unit abuts against the surface.

With this configuration, the abutting unit abuts against the adhesive layer of the transport belt, and thus adheres to the surface of the adhesive layer. The abutting unit moves in the first direction away from the transport belt, and thus the abutting unit is caused to peel off from the surface of the adhesive layer. The displacement detection unit detects the displacement amount of the transport belt in the first direction during this process, and thus an adhesive force of the adhesive layer is detected. With this, as compared to a case in which an adhesive force is detected through sliding in the direction along the surface of the adhesive layer (the transport direction/the width direction), the adhesive layer is less worn, and rapid degradation of the adhesive layer (reduction of an adhesive force) can be suppressed. Thus, sliding friction between the abutting unit and the transport belt is suppressed at the time of detecting presence or absence of degradation of the adhesive layer. Thus, presence or absence of degradation of the adhesive layer can be detected while suppressing rapid degradation of the adhesive layer.

(B) In the transport device described above, the displacement detection unit may detect the displacement amount of the transport belt in the first direction in a non-contact manner.

With this configuration, the displacement detection unit is capable detecting the displacement amount of the transport belt in a non-contact manner, and hence degradation of the adhesive layer can be suppressed more than contact-type detection.

(C) In the transport device described above, the abutting unit may be a pressurizing roller that pressurizes the medium against the adhesive layer.

With this configuration, the pressurizing roller is used as the abutting unit. Thus, the displacement amount of the transport belt in the first direction can be detected with a simple configuration.

(D) The transport device described above may further include a control unit configured to determine whether the adhesive layer is degraded, based on the displacement amount detected by the displacement detection unit, and a notification unit configured to issue a notification of information, wherein, when it is determined that the adhesive layer is degraded, the control unit may cause the notification unit to issue a notification of information indicating degradation of the adhesive layer.

With this configuration, a user is allowed to sense degradation of the adhesive layer in an objective manner.

(E) The transport device described above may further include a heating unit configured to heat the adhesive layer in a pressurizing region in which the pressurizing roller pressurizes the surface of the adhesive layer or at a position upstream of the pressuring region in a circling direction of the transport belt, wherein the control unit may adjust a temperature the adhesive layer heated by the heating unit, in accordance with a determination result indicating whether the adhesive layer is degraded.

With this configuration, a temperature of the adhesive layer is increased, and thus an adhesive force of the degraded adhesive layer can be temporarily increased.

(F) In the transport device described above, the control unit may cause the moving mechanism to adjust a position of the pressurizing roller with respect to the adhesive layer, in accordance with a determination result indicating whether the adhesive layer is degraded, and thus may adjust a pressure of the pressurizing roller onto the adhesive layer.

With this configuration, a pressure with respect to the adhesive layer is increased, and thus an adhesive force of the degraded adhesive layer can be temporarily increased.

(G) A printing apparatus includes a transport belt having an adhesive layer to which a medium is adherable and being configured to transport the medium adhering to the adhesive layer, a printing unit configured to perform printing on the medium transported by the transport belt, an abutting unit configured to abut against a surface of the adhesive layer, a moving mechanism configured to move a position of the abutting unit with respect to the surface in a first direction and a second direction, the first direction being a direction in which the abutting unit is away from the adhesive layer, the second direction being a direction opposite to the first direction and a direction in which the abutting unit approaches the adhesive layer, and a displacement detection unit configured to detect a displacement amount of the transport belt in the first direction, when the moving mechanism moves the abutting unit in the first direction while the abutting unit abuts against the surface.

With this configuration, in the printing apparatus, sliding friction between the abutting unit and the transport belt is suppressed at the time of detecting presence or absence of degradation of the adhesive layer. Thus, presence or absence of degradation of the adhesive layer can be detected while suppressing rapid degradation of the adhesive layer.

What is claimed is:

1. A transport device, comprising:

a transport belt having an adhesive layer to which a medium is adherable and being configured to transport the medium adhering to the adhesive layer;

an abutting unit configured to abut against a surface of the adhesive layer;

a moving mechanism configured to move a position of the abutting unit with respect to the surface in a first direction and a second direction, the first direction being a direction in which the abutting unit is away from the adhesive layer, the second direction being a direction opposite to the first direction and a direction in which the abutting unit approaches the adhesive layer; and a displacement detection unit configured to detect a displacement amount of the transport belt in the first direction when the moving mechanism moves the abutting unit in the first direction while the abutting unit abuts against the surface.

2. The transport device according to claim 1, wherein the displacement detection unit detects the displacement amount of the transport belt in the first direction in a non-contact manner.

3. The transport device according to claim 1, wherein the abutting unit comprises a pressurizing roller that pressurizes the medium against the adhesive layer.

4. The transport device according to claim 3, comprising:

a control unit configured to determine whether the adhesive layer is degraded, based on the displacement amount detected by the displacement detection unit; and a notification unit configured to issue a notification of information, wherein when it is determined that the adhesive layer is degraded, the control unit causes the notification unit to issue a notification of information indicating degradation of the adhesive layer.

5. The transport device according to claim 4, comprising:

a heating unit configured to heat the adhesive layer in a pressurizing region in which the pressurizing roller pressurizes the surface of the adhesive layer or at a position upstream of the pressuring region in a circling direction of the transport belt, wherein the control unit adjusts a temperature of the adhesive layer heated by the heating unit, in accordance with a determination result indicating whether the adhesive layer is degraded.

6. The transport device according to claim 4, wherein the control unit causes the moving mechanism to adjust a position of the pressurizing roller with respect to the adhesive layer, in accordance with a determination result indicating whether the adhesive layer is degraded, and thus adjusts a pressure of the pressurizing roller onto the adhesive layer.

7. A printing apparatus, comprising:

a transport belt having an adhesive layer to which a medium is adherable and being configured to transport the medium adhering to the adhesive layer;

a printing unit configured to perform printing on the medium transported by the transport belt;

an abutting unit configured to abut against a surface of the adhesive layer;

a moving mechanism configured to move a position of the abutting unit with respect to the surface in a first direction and a second direction, the first direction being a direction in which the abutting unit is away from the adhesive layer, the second direction being a direction opposite to the first direction and a direction in which the abutting unit approaches the adhesive layer; and a displacement detection unit configured to detect a displacement amount of the transport belt in the first direction, when the moving mechanism moves the abutting unit in the first direction while the abutting unit abuts against the surface.

* * * * *